US006902050B2

(12) United States Patent
Jones

(10) Patent No.: US 6,902,050 B2
(45) Date of Patent: Jun. 7, 2005

(54) COIN MECHANISM OF SIMPLIFIED CONSTRUCTION AND METHOD OF COIN VALIDITY TESTING AND VENDING MACHINE OPERATION

(75) Inventor: Wayne H. Jones, Idaho Falls, ID (US)

(73) Assignee: Advantedge LLC, Idaho Falls, ID (US)

( * ) Notice: Subject to any disclaimer, the term of this patent is extended or adjusted under 35 U.S.C. 154(b) by 181 days.

(21) Appl. No.: 10/455,009

(22) Filed: Jun. 5, 2003

(65) Prior Publication Data

US 2004/0245067 A1 Dec. 9, 2004

(51) Int. Cl.[7] ..... G07D 5/08; G07D 5/02
(52) U.S. Cl. ..... 194/335; 194/327
(58) Field of Search ..... 194/335, 232, 194/237, 236, 233, 234, 235, 334, 338

(56) References Cited

U.S. PATENT DOCUMENTS 693,157 A * 2/1902 Roebuck et al. ..... 194/303
2,091,232 A * 8/1937 Vogel et al. ..... 194/320
5,339,937 A * 8/1994 Bolen ..... 194/292
5,657,848 A 8/1997 Schwarzli ..... 194/236

* cited by examiner

*Primary Examiner*—Donald P. Walsh
*Assistant Examiner*—Mark J. Beauchaine
(74) *Attorney, Agent, or Firm*—John R. Ley

(57) ABSTRACT

The validity of a coin is tested in a coin mechanism typically used for vending products. A test arm which is integrally and resiliently connected to a back plate contacts a coin when the coin wheel is rotated, and the test arm resiliently deflects in response to contact with the characteristic of the coin tested. The validity of the coin is established by the degree of movement of the test arm. More than one test arm functions to test different characteristics of the coin to establish validity and the prevent illegitimate dispensing of products. When a coin is not present, the test arm is not deflected to maintain its resiliency characteristics. Preferably the coin mechanism is assembled from a relatively few injection molded durable plastic parts.

27 Claims, 17 Drawing Sheets

COIN MECHANISM OF SIMPLIFIED CONSTRUCTION AND METHOD OF COIN VALIDITY TESTING AND VENDING MACHINE OPERATION

The present invention relates to a coin mechanism of the type typically used with a vending machine, and to testing the validity of a coin and operating a vending machine in response to detecting a valid coin. More particularly the present invention relates to a new and improved coin mechanism having a simplified construction involving fewer parts made of advantageous plastic materials which facilitate assembly of the coin mechanism, and a new and improved method of testing the validity of the coin and operating a vending machine.

BACKGROUND OF THE INVENTION

A coin mechanism is a device which accepts one or more coins, tests the validity of the coins, and permits the proper and intended operation of a vending machine to dispense a product from the machine in response to valid payment. In addition, the coin mechanism must retain the money accepted. In a sense, the coin mechanism acts as a lock or mechanism to prevent products from being dispensed from the vending machine until valid payment is made.

Coin mechanisms have, in the past, employed a relatively large number of parts and have been of relatively complex construction. The large number parts were required to perform the various distinct and important functions of coin acceptance, coin validity testing, and product dispensing. Moreover, the large number parts have usually been cast from metal. Many of the parts used in a conventional coin mechanism are also spring-biased. Metal parts interact on a reliable basis with metal spring elements which create the bias force necessary to make certain parts function effectively.

One of the disadvantages of previous coin mechanisms employing a relatively large number of metal parts, including springs, is that the assembly of the overall mechanism is complex and time-consuming. Orienting all the parts and connecting them together and inserting the springs between the parts involves a significant amount of human labor. The labor costs, as well as the increased costs associated with the fabricating a relatively large number of individual parts, has increased the cost of prior coin mechanisms. Furthermore, the costs of servicing such coin mechanisms is also relatively high, for the same reasons involving complexity in assembly and disassembly of the relatively large number of parts involved.

These and many other considerations applicable to previous coin mechanisms have given rise to the present invention.

SUMMARY OF THE INVENTION

The coin mechanism of the present invention offers a significant improvement in regard to reducing the number of individual parts which must be fabricated to construct a fully functional coin mechanism. Another improvement of the present invention is the capability of integrating multiple individual and separate parts into single parts which perform all the functions of the previous separate parts, thereby reducing the overall parts count of the coin mechanism. Reducing the parts count facilitates the assembly of the coin mechanism because a lesser number of parts must be assembled. The amount of time is required for assembly of the coin mechanism is reduced because of the integrated functionality provided by the lesser number of parts. Moreover, the fewer number of parts with the integrated multiple functionality are susceptible to fabrication from plastic by injection molding, which further reduces the manufacturing costs. The plastic parts have wear resistance and strength which are typically better than metal parts. Injection molded plastic parts are also generally less expensive to fabricate on a large-scale basis, compared to metal parts. The reduced number of parts, reduced fabrication cost and simplicity of assembly also facilitate service and repair of the coin mechanism, because any malfunctioning parts can be replaced on a convenient, economic and rapid basis. The present invention obtains all of these advantages and improvements, as well as others, without compromising the essential functionality of the coin mechanism of accepting only valid coins and permitting only the intended vending operation in response to valid payment.

In accordance with these and other improvements, a coin mechanism comprises a back plate and a coin wheel positioned to rotate adjacent and relative to the back plate. The coin wheel includes a receptacle within which to receive the coin. At least one test arm is integrally connected to the back plate and extends to a position over the coin wheel to contact the coin within the receptacle. The test arm moves in response to a characteristic of the coin contacted, and the degree of movement of the test arm indicates validity with respect to the tested characteristic.

A method of testing validity of a coin is also one of the improvements of the present invention. The method comprises positioning a coin in a receptacle of a coin wheel, positioning a back plate stationarily relative to the coin wheel, extending a test arm which is integrally connected to the back plate into contact the coin within the receptacle of the coin wheel, rotating the coin wheel in a first rotational direction with the coin in the receptacle, moving the test arm in response to contact with the coin in the receptacle in the coin wheel as or after the coin wheel rotates, and determining validity of the tested characteristic of the coin by the degree of movement of the test arm. One or more test arms may be employed to test multiple characteristics of the coin to determine its validity, including thickness, diameter and presence and absence of holes in the coin.

Preferred aspects of both the coin mechanism and the method of the present invention relate to preventing rotation of the coin wheel in at least one rotational direction until the test arm has moved to the degree necessary to indicate validity, while permitting rotation of the coin wheel in the other direction even if the coin is tested as invalid. Preferably, one or more test arms extend from the back plate in a cantilever manner. The degree of movement of each test arm which indicates validity preferably occurs in opposition to bias force resulting from deflecting the test arm, but the test arm is substantially free of bias force when in a non-deflected position. The coin mechanism is preferably connected to rotate a dispenser to dispense the vended product upon determining the validity of the coin, and an anti-rotational arm is preferably integrally connected to the back plate in a similar manner to prevent rotation of the coin wheel and the connected dispenser in a rotational direction opposite of the rotational direction which resulted in determining the validity of the coin. Each of the relatively few components used in the coin mechanism and involved in the validity testing method is preferably formed by injection molding from acetal plastic. Acetal plastic provides good strength, possesses resilience for spring memory characteristics, exhibits very good resistance to wear, and is capable of injection molding.

A more complete appreciation of the scope of the present invention and the manner in which it achieves the above-noted and other improvements can be obtained by reference to the following detailed description of a presently preferred embodiment taken in connection with the accompanying drawings, which are briefly summarized below, and by reference to the appended claims.

DETAILED DESCRIPTION

Figure 1:
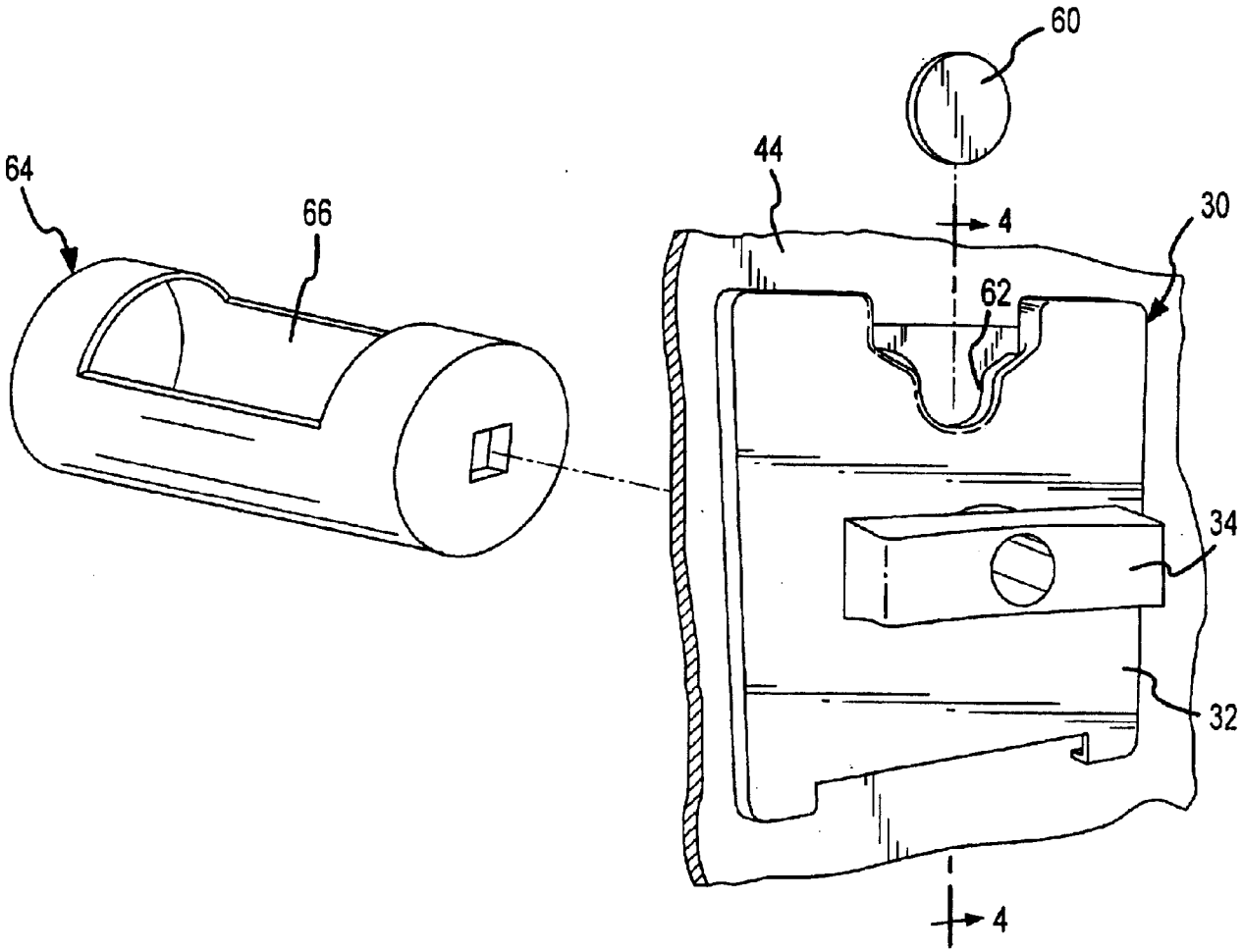
FIG. 1 is a front perspective view of a coin mechanism embodying the present invention, including a portion of an exterior housing, and a dispenser drum of the vending machine which is shown in an exploded relationship from the coin mechanism.

An embodiment of a coin mechanism 30 which operates in regard to a single coin and which incorporates the present invention is generally shown in FIGS. 1–21. As shown primarily in FIGS. 1–4, the coin mechanism 30 includes a front plate 32, a handle 34 with a connected shaft 36 which is inserted through the front plate 32, a coin wheel 38 which is connected to the shaft 36, and a back plate 40 which is positioned relative to the front plate 32 by the shaft 36 and by screws 42. In the assembled coin mechanism 30, the coin wheel 38 is located and positioned for rotation between the front plate 32 and the back plate 40. The coin mechanism 30 is attached to an outside housing 44 of a vending machine (not otherwise shown). The front plate 32 is located on the front or outside surface of the housing 44 and the back plate 40 is located on the back or inside surface of the housing 44. The screws 42 hold the front and back plates of the coin mechanism 30 in assembled relationship with respect to one another, and also retain the coin mechanism to the vending machine by capturing the housing 44 between the front plate 32 and the back plate 40.

The front plate 32 includes a cylindrical hole 46, and the back plate 40 includes a cylindrical hole 48, through which the shaft 36 extends. A cylindrical surface 50 (FIG. 3) is formed on the shaft 36 adjacent to the handle 34. The cylindrical surface 50 is received within the cylindrical hole 46. The shaft 36 is square or rectangular in cross-section at locations other than the cylindrical surface 50. A correspondingly-shaped square or rectangular hole 52 is formed in the coin wheel 38, and the square cross-sectional portion of the shaft 36 fits within the square hole 52. A cylindrical sleeve 54 surrounds the square hole 52 in the coin wheel 38. The cylindrical sleeve 54 extends within the cylindrical hole 48 of the back plate 40. An end piece 56 is connected to the end of the shaft 36 by a screw 58. The end piece 56 contacts the backside of the back plate 40 and prevents the shaft 36 from moving axially forward out of the coin mechanism 30. The end piece 56 includes a square or rectangle or terminal end shape which fits within a correspondingly shaped square or rectangular opening in an end wall of a dispenser drum 64 (FIG. 1).

Figure 6:
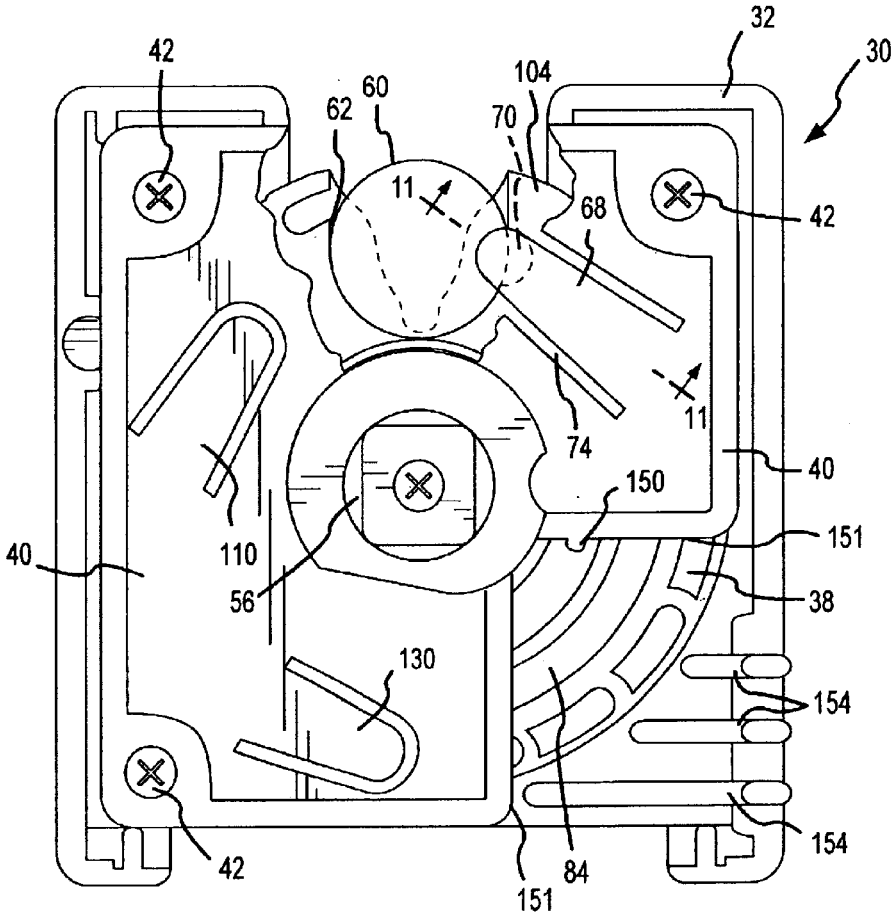
FIG. 6 is an enlarged rear elevation view of the coin mechanism shown in FIG. 2, with a portion of a back plate of the coin mechanism broken away to illustrate a home or stop position where the coin wheel shown in FIG. 5 begins and ends rotational movement.

Twisting the handle 34 rotates the shaft 36 and the connected coin wheel 38 between the stationary front and rear plates 32 and 40. A coin 60 (FIG. 1) is inserted in a receptacle 62 of the coin wheel 38 when the coin wheel 38 occupies a home or stop position shown in FIGS. 1, 3, 4 and 6. Inserting a coin 60 of valid thickness releases the coin wheel 38 for rotational movement from the home position (FIG. 6). Forward rotational movement is in the clockwise direction shown in FIG. 1 and rotational movement in the rearward direction is in the counterclockwise direction shown in FIGS. 2, 3 and 6–10.

Figure 7:
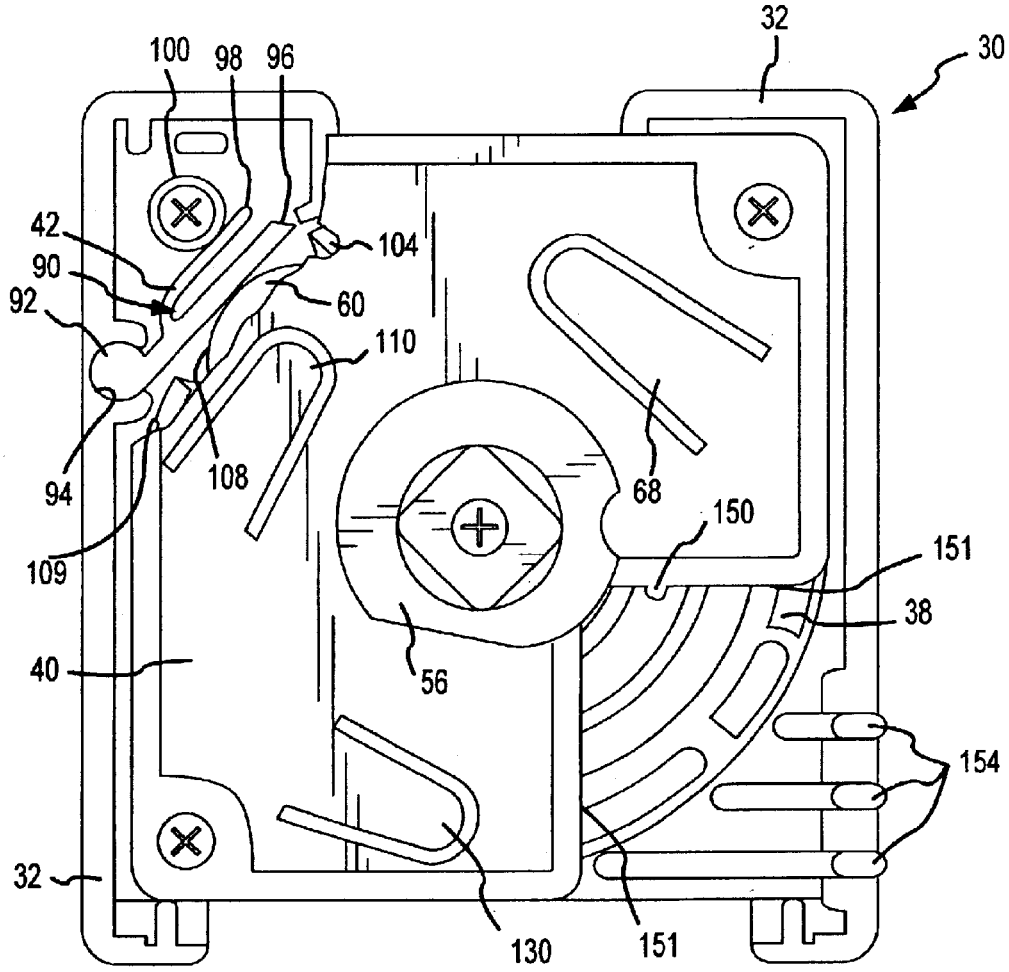
FIG. 7 is an enlarged rear elevation view of the coin mechanism, similar to FIG. 6, with a portion of the back plate of the coin mechanism broken away to illustrate a rotational position of the coin wheel where a diameter of an inserted coin is tested.

Forward rotational movement of the coin wheel 38 from the home position shown in FIG. 6 positions the inserted coin 60 at the position shown in FIG. 7, where the diameter of the inserted coin 60 is tested. Provided that the inserted coin 60 has the diameter of a valid coin, further rotation of the coin wheel of 38 in a forward direction is possible and the inserted coin 60 is moved forward to the position shown in FIG. 8. At the position shown in FIG. 8, the inserted coin 60 is tested to determine whether it has a hole in its center and the thickness of the coin is checked again. Valid coins do not have center holes. The thickness, diameter and hole tests performed at the rotational positions shown in FIGS. 6, 7 and 8, respectively, determine whether the inserted coin 60 is valid payment for the product to be dispensed from the vending machine.

Upon confirming the validity of the coin 60, further rotation of the handle 34 and shaft 36 rotates a connected dispenser drum 64 (FIGS. 1 and 2) to a position or orientation where product (not shown) within the dispenser drum 64 dumps or spills out of the rotated dispenser drum 64 through an opening 66 formed in the dispenser drum 64. In this position, the handle 34 and the connected dispenser drum 64 are prevented from being rotated back and forth in oscillating manner to attempt illegitimately to reload the dispenser drum 64 through the opening 66 with additional product and dispense the additional product with only the single payment represented by the single coin 60. Reloading the dispenser drum 64 with product occurs when the opening 66 in the dispenser drum 64 faces upward. Preventing the dispenser drum 64 from rotating in the reverse direction prevents reloading the dispenser drum after the product has been dumped from the opening 66. The dispenser drum 64 is connected to the coin mechanism by inserting the square or rectangular shaped portion of the terminal end piece 56 (FIG. 2) into a correspondingly shaped opening formed in an end wall of the dispenser drum 64, as understood from FIG. 1. In this manner, rotation of the shaft 36 and the connected end piece 56 also rotates the dispenser drum 64.

Figure 10:
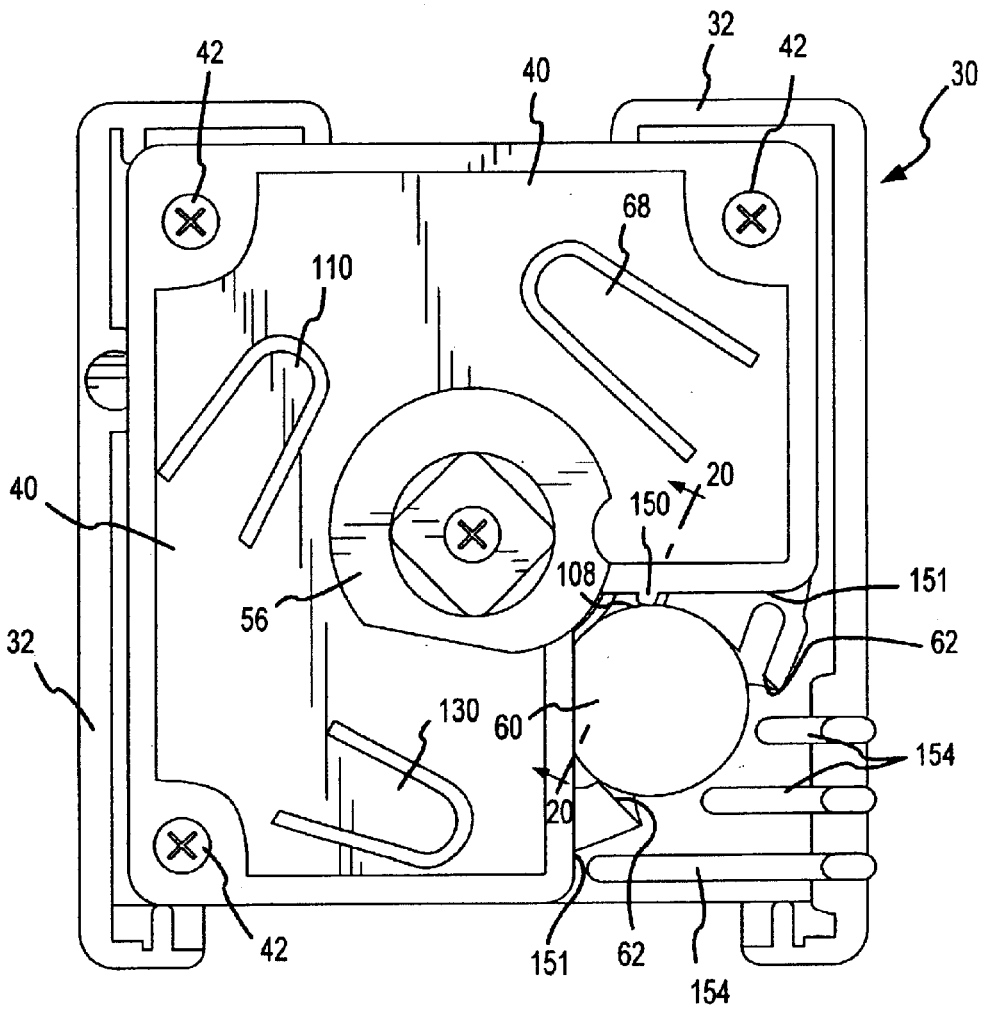
FIG. 10 is an enlarged rear elevation view of the coin mechanism, similar to FIG. 9, with a portion of the back plate of the coin mechanism broken away to illustrate a rotational position of the coin wheel where the inserted coin is extracted.

After the product has been dispensed, further forward rotation positions the coin wheel 38 at the position shown in FIG. 10. In this position, the coin 60 is extracted from the receptacle 62 in the coin wheel 38. The extracted coin is directed by gravity from the coin mechanism 30 into a secure collecting container of the vending machine (not shown). Further rotational movement from the position shown in FIG. 10 returns the coin wheel 38 back to the home or stop position shown in FIG. 6, where the coin validity determining and product dispensing sequence may begin again upon the insertion of another coin and again twisting the handle 34. More product is also reloaded through the opening 66 of the dispenser drum 64 while in the home or stop position.

The manner in which the relatively few parts of the coin mechanism 30 interact with each other to accept the coin, to test its validity, to vend only a single quantity of the dispensed product, to extract the coin and to return to begin another such sequence is described in greater detail below.

Figure 11:
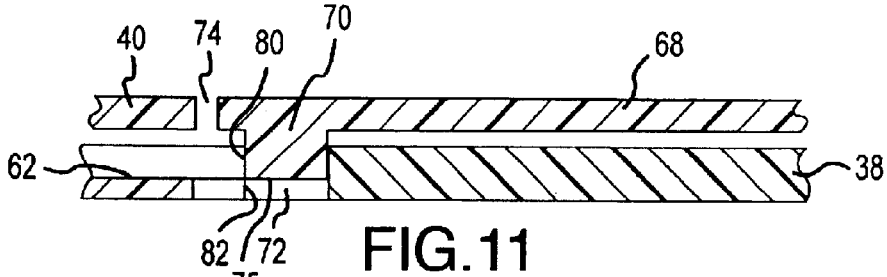
FIG. 11 is a sectional view taken substantially in the plane of line 11—11 of FIG. 6, but with the coin shown in FIG. 6 removed from the coin wheel.

At the home stop position shown in FIG. 6, an arm 68 of the back plate 40 normally positions a pin 70 (FIG. 11) and its lower end 75 within a hole 72 (FIGS. 5 and 11) formed in the coin wheel 38. The arm 68 is formed as an integral part of a generally planar structure of the back plate 40. A U-shaped slot 74 (FIGS. 2 and 3) separates the arm 68 from the other portion of the back plate 40, but leaves the arm 68 attached to the back plate 40 to extend in a cantilevered manner. The pin 70 is located at the terminal end of the arm 68 opposite of the integral connection of the arm 68 to the back plate 40. As shown in FIG. 11, the pin 70 extends from the arm 68 toward the coin wheel 38 to a greater distance than the back plate 40 is separated from the coin wheel 38. When the coin mechanism 30 is not used and no coin 60 is inserted in the receptacle 62 of the coin wheel 38, the arm 68 extends essentially in a planar relationship with the remaining portion of the back plate 40 and occupies a normal, relaxed, non-biased state.

In the normal, non-biased position of the arm 68, the pin 70 extends into the hole 72 of the coin wheel 38, as shown in FIG. 11. The pin 70 is generally cylindrical in cross-section, and is slightly smaller in diameter than the diameter of the hole 72, thereby permitting the pin 70 to move into the hole 72. With the pin 70 in the hole 72, the coin wheel 38 can not be rotated in the reverse direction.

Figure 12:
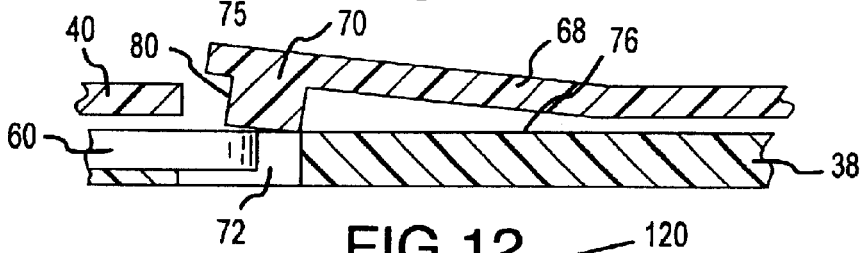
FIG. 12 is a sectional view similar to FIG. 11, but showing the coin inserted in the coin wheel.

The handle 34 and the coin wheel 38 can only be rotated in the forward direction as a result of inserting a proper-thickness coin 60 into the receptacle 62 of the coin wheel 38. When the coin 60 is inserted in the receptacle 62, an edge of the coin 60 initially contacts a beveled surface (not shown) on the side of the pin 70 leading to a lower end 75 of the pin 70. The edge of the coin 60 slides along this beveled surface and forces the arm 68 upward, away from the coin wheel 38, as shown in FIGS. 6 and 12. Because the thickness of the receptacle 62 is the same as the thickness of the coin 60, the lower end 75 of the pin 70 is approximately at the level of an upper surface 76 of the coin wheel 38, as shown in FIG. 12. In this position, the pin 70 is withdrawn from the hole 72 and will no longer serve as an impediment to rotating the coin wheel 38. If the coin 60 is invalid because it has less than the desired thickness, the lower end 75 of the pin 70 will not be elevated to the upper surface 76 of the coin wheel 38. Instead the lower end 75 will remain partially in the hole 72, to prevent rotation of the coin wheel 38.

As shown in FIGS. 11 and 12, the pin 70 has a cylindrical sidewall 80 which extends from the arm 68. The cylindrical sidewall 80 directly confronts a cylindrical sidewall 82 of the of the hole 72. Consequently, rotational movement of the coin wheel 38 is stopped and prevented because of the contact of the sidewalls 80 and 82 when the coin wheel 38 is rotated to the stop position. However, a beveled surface (not shown) located on a side of the pin 70 permits a coin 60 inserted in the receptacle 62 to lift or move the arm 68 to a position which releases the coin wheel for rotation from the home position in the forward direction as shown in FIG. 6.

If an invalid coin which is too thick is attempted to be inserted into the receptacle 62, the shallower depth of the receptacle 62 will prevent that invalid coin from being inserted into the receptacle 62. If an invalid coin which is too thin is inserted into the receptacle 62, its thickness will be insufficient to lift the lower end 75 of the pin 70 completely out of the hole 72, and a small portion of the cylindrical surfaces 80 and 82 will remain in contact with one another to prevent rotation of the coin wheel 38 in the forward direction.

When the coin wheel 38 rotates from the home position shown in FIG. 6, the lower end 75 of the pin 70 of the arm 68 rides on top of a ridge which is located beyond the outside circumference of a groove 84 (FIG. 5) in the coin wheel 38 between grooves 84 and 136. A slanted surface 86 (FIG. 5) is located at the opposite end of the groove 84. The arm 68 thus moves out of its normal, non-biased position only when a coin 60 is inserted into the receptacle 62 and the coin mechanism 30 is operated. Even then, the bias force induced on the arm 68 is only momentary, because insertion of the coin 60 is followed immediately by rotation of the coin wheel 38 to start the coin testing and product vending sequence. Consequently, the stop and release arm 68 does not experience bias force or tension for a significant amount of time. By minimizing the time during which the bias force is applied, the arm 68 is not permanently deformed, but instead the resiliency of the arm 68 is maintained at an effective level to function in the manner described. Minimizing the time of application of the bias force allows the arm 68 to be formed from the same type of material, preferably acetal plastic, as the back plate 40, so that its spring memory characteristics are maintained.

Figure 13:
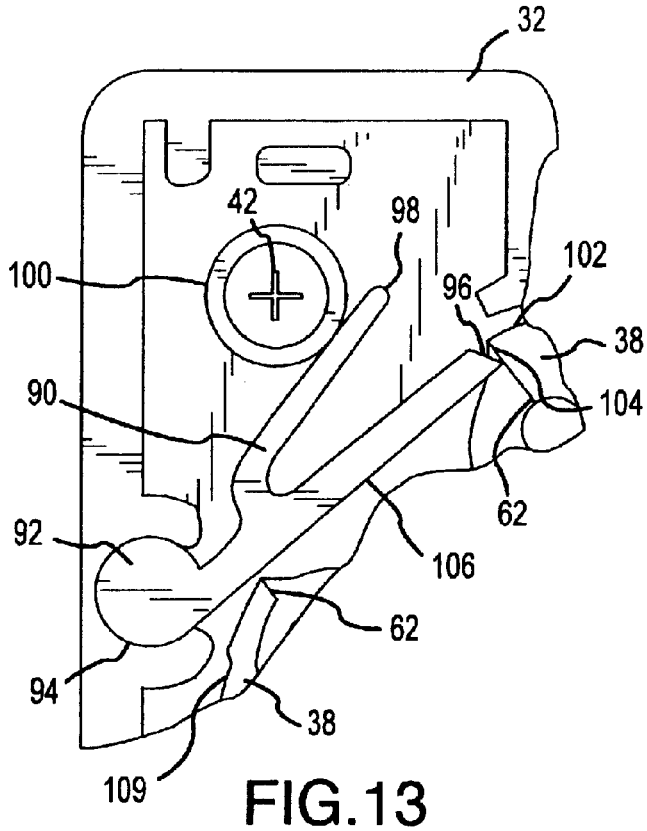
FIG. 13 is an enlarged view of a portion of FIG. 7 showing a test arm in a position when no coin has been inserted in the coin wheel.
Figure 14:
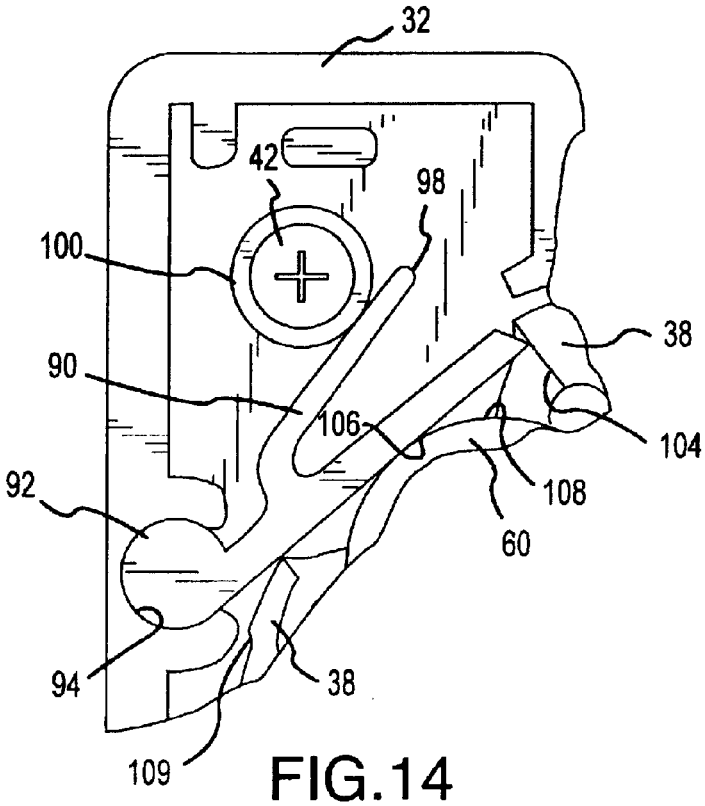
FIG. 14 is a view similar to FIG. 13, showing the test arm in a position to measure the diameter of an undersized coin inserted in the coin wheel.

With the arm 68 biased by the inserted coin 60 to a position which allows rotation of the coin wheel 38, twisting the handle 34 rotates the coin wheel 38 in the forward direction to the position shown in FIG. 7, where a lever 90 tests the diameter of the inserted coin 60. As shown in FIGS. 7, 13 and 14, the lever 90 includes a circular ball-like end 92 which is pivotally received in a cylindrical socket 94. The cylindrical socket 94 is formed in the front plate 32. An end 96 of the lever 90, which is opposite of the ball end 92, has a surface which extends slightly less than perpendicular with respect to the longitudinal dimension of the lever 90. A bias lever portion 98 extends from the lever 90 in the opposite direction from the coin wheel 38 and contacts a boss 100 formed in the front plate 32. One of the screws 42 (FIG. 3) extends into the boss 100 when the back plate 40 is attached to the front plate 32.

The bias lever portion 98 of the lever 90 normally biases the arm 90 toward a clockwise direction as shown in FIGS. 7, 13 and 14, as a result of its contact with the boss 100. In this normal position, shown in FIG. 13, the end 96 will normally extend into the receptacle 62 to a position which is slightly radially inward from the outer circumferential surface 102 of the coin wheel 38. Consequently, if the coin wheel 38 is rotated with the insertion of a coin of less than the proper proper diameter, the end 96 will contact an inward-extending corner surface 104 of the receptacle 62 to prevent further forward rotation of the coin wheel. In this manner, the lever 90 prevents rotation of the coin wheel 38 past the position shown in FIG. 13 if the coin inserted in the receptacle 62 is less than the proper diameter. Coins of greater than the proper diameter can not be inserted because the receptacle 62 is sized to prevent the insertion of coins of larger than the desired diameter.

The lever 90 includes a contact surface 106 located approximately midway between the ends 92 and 96 on the side of the lever 90 which faces the coin wheel 38. With a coin 60 inserted in the receptacle 62 (FIGS. 7 and 14), the contact surface 106 will contact and ride up on the outside circular surface 108 of the coin 60 as the rotating coin wheel 38 moves the coin in the forward rotational direction, as shown in FIG. 14. Contact with the outside circumferential surface 108 of the proper diameter coin 60 pivots the lever 90 in a clockwise direction around the end 92, as shown in FIG. 14, as a result of the contact surface 106 contacting the outside surface 108 of the coin 60. If the diameter of the inserted coin 60 is correct, the end 96 of the lever 90 will move radially outward slightly beyond the outside circumferential surface 102 of the coin wheel 38, as shown in FIG. 7. In this radially outward position, the end 96 will not contact the corner surface 104. The coin wheel 38 can therefore continue further forward rotational movement. However, if the diameter of the inserted coin 60 is too small, the end 96 will not pivot outward a sufficient distance for the end 96 to clear the corner surface 104 of the receptacle 62, and instead the end 96 will contact the corner surface 104 to prevent further forward rotation of the coin wheel 38, as shown in FIG. 14. A coin 60 having a diameter which is too small will still permit the reverse or rearward rotation (clockwise as shown in FIGS. 7, 13 and 14) of the coin wheel 38, because the pivot position of the arm 90 at the ball end 92 and length of the arm 90 are incapable of contacting any portion of the coin wheel 38 to interfere with rearward rotation. Permitting rotation in the reverse direction back to the home position allows extraction of an improper coin from the coin receptacle 62.

The bias lever portion 98 of the arm 90 undergo bias only when the contact surface 106 contacts the outside circumferential surface 108 of the inserted coin 60 and/or the outside circumferential surface 102 of the coin wheel 38. When the coin wheel 38 is in the home position (FIG. 6), the end 96 of the lever 90 is located in a recess 109, shown in FIG. 5, formed the outside circumferential surface 102 of the coin wheel 38. The recess 109 (FIG. 5) extends radially inward to the extent necessary to prevent any deflection on the bias lever portion 98 of the arm 90, thereby eliminating any bias force on the arm 90 when it is in the normal, home position. The bias lever portion 98 contacts the boss 100 and deflects slightly to create a bias force in a direction toward the coin wheel 38 only when the end 96 of the lever 90 contacts the outside circumferential surface 102 of the coin wheel 38 or the outside circumferential surface 108 of the inserted coin. The deflection is resisted by the strength of the material, preferably acetal plastic, from which the arm 90 is made. The deflection forces the contact surface 106 firmly against the outside circumferential surface 108 of the coin 60. In this manner, the bias force assures that an accurate measurement of the diameter of the coin 60 will be made, and further assures that undersized coins will not permit the coin wheel 38 to be rotated beyond the position shown in FIG. 7, as a result of the bias force from the bias lever portion 98 forcing the end 96 into contact with the corner surface 104.

Figure 8:
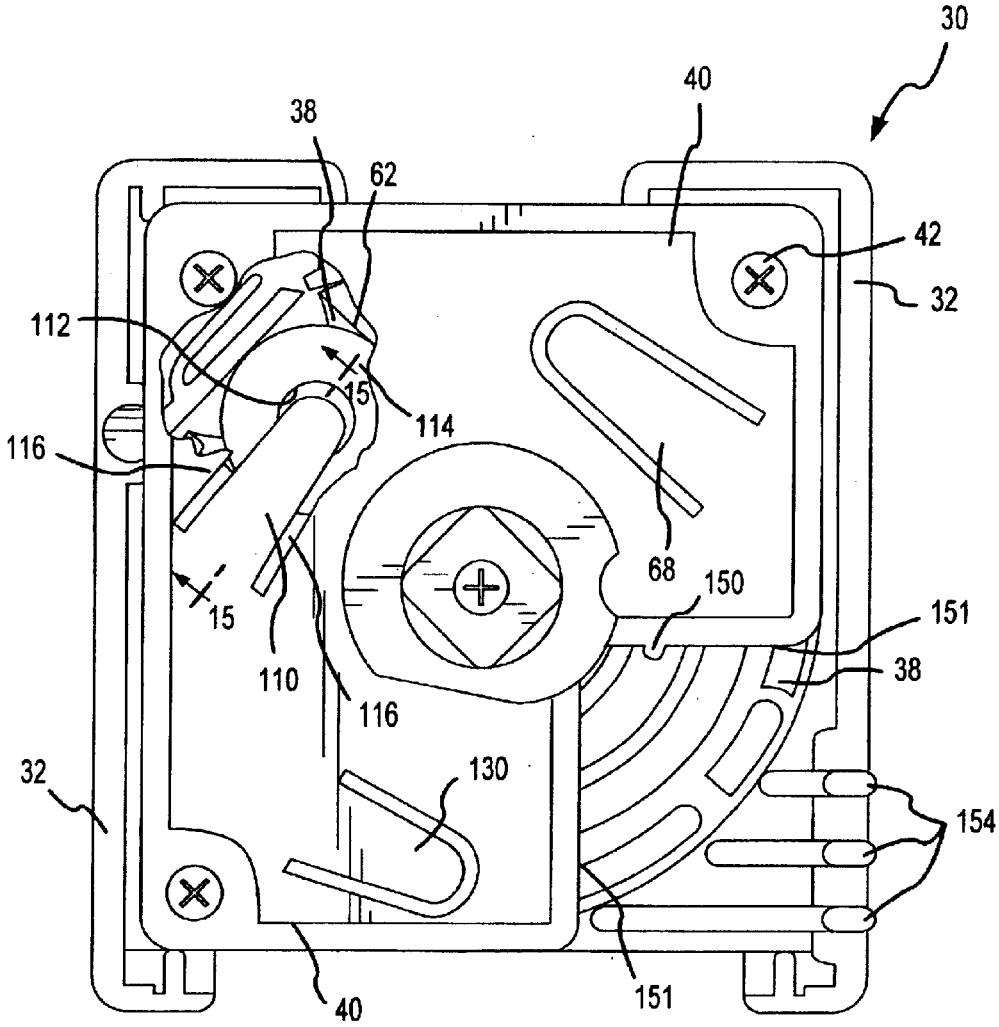
FIG. 8 is an enlarged rear elevation view of the coin mechanism, similar to FIG. 7, with a portion of the back plate of the coin mechanism broken away to illustrate a rotational position of the coin wheel where the inserted coin is tested to determine whether it has a hole.
Figure 9:
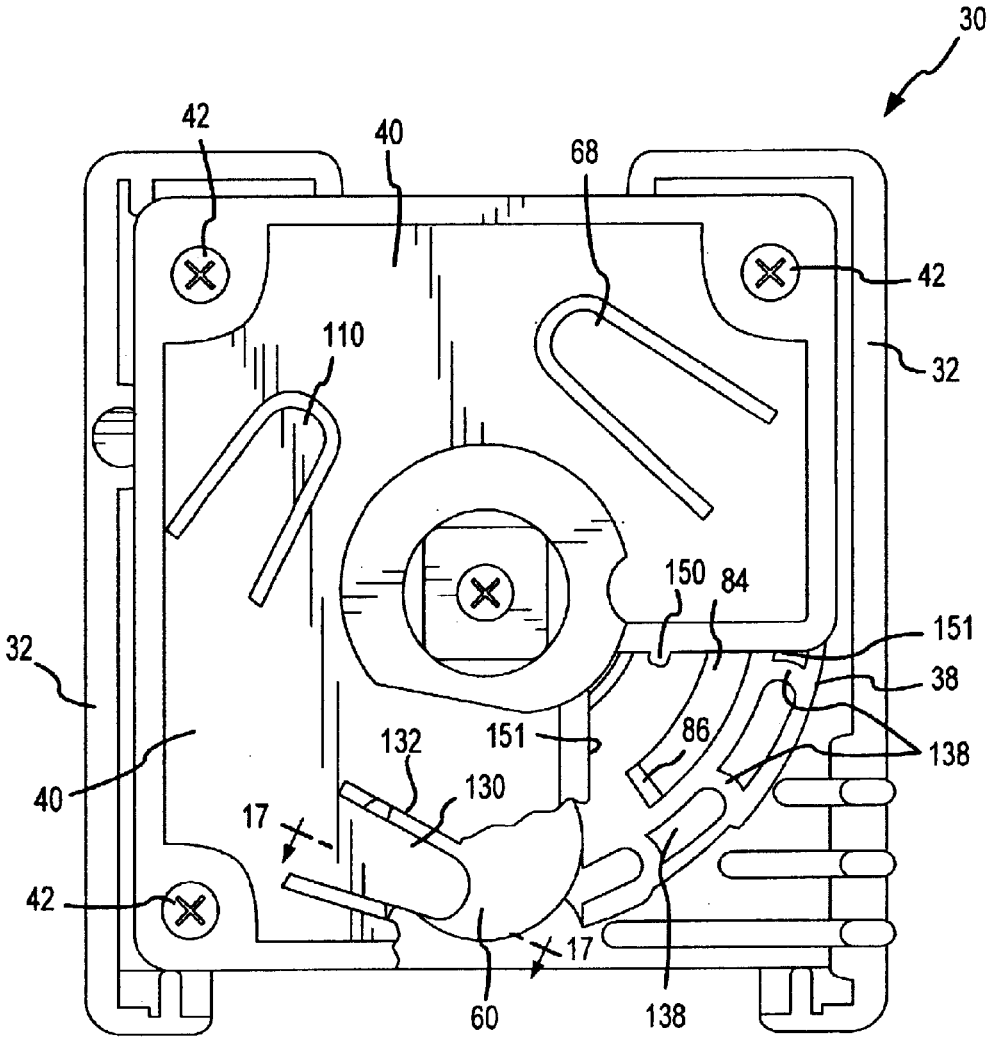
FIG. 9 is an enlarged rear elevation view of the coin mechanism, similar to FIG. 8, with a portion of the back plate of the coin mechanism broken away to illustrate a rotational position of the coin wheel where product from a vending machine is dispensed.

With a proper diameter coin 60, the coin wheel may be rotated in the forward direction to the next position shown in FIG. 8. At the position shown in FIG. 8, an arm 110 tests for the presence or absence of a hole 112 (FIGS. 15 and 16) in the inserted object and again tests for the proper thickness. The presence of a hole 112 in the center of the inserted object indicates an invalid coin, such as a washer 114, for example. The arm 110 is connected to the back plate 40, preferably as an integrated, cantilevered structure created by a slot 116 in essentially the same manner as the arm 68 is connected to the back plate 40 (FIG. 6).

Figure 5:
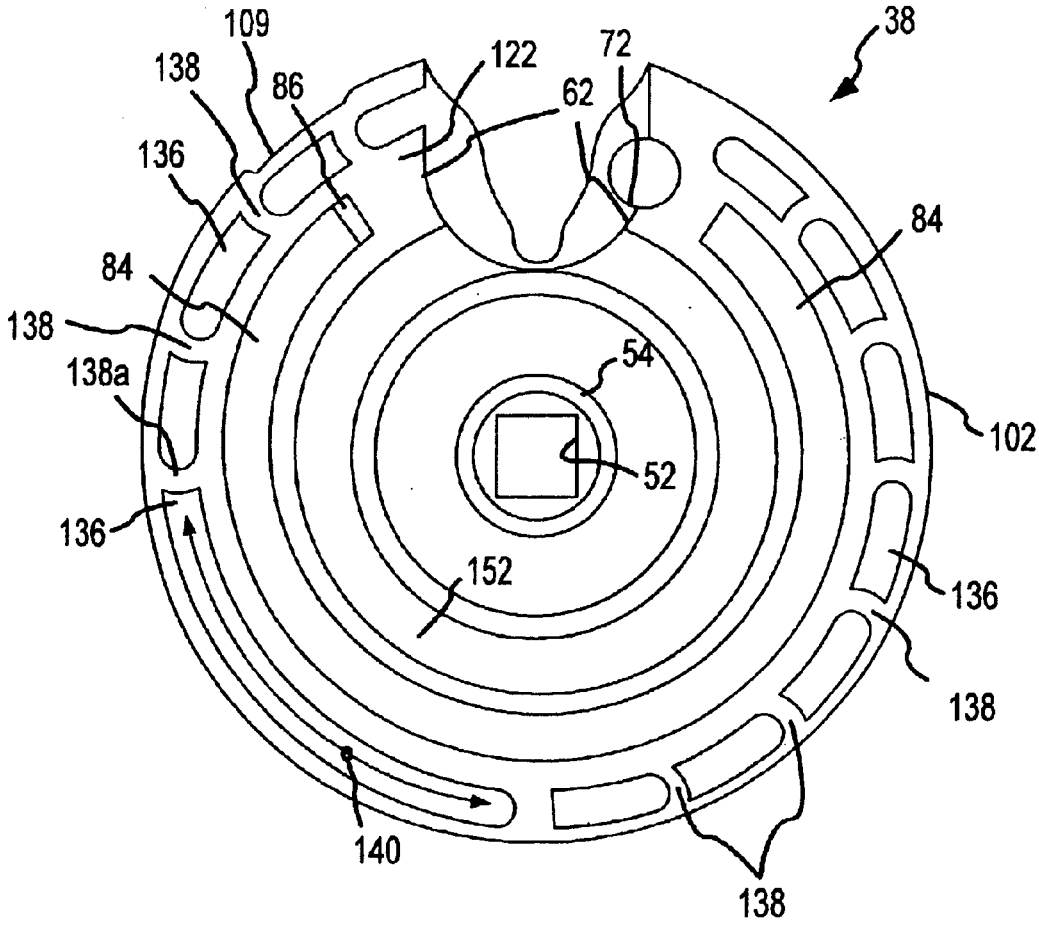
FIG. 5 is an enlarged elevation view of a coin wheel of the coin mechanism taken substantially in the plane of line 5—5 of FIG. 4.
Figure 15:
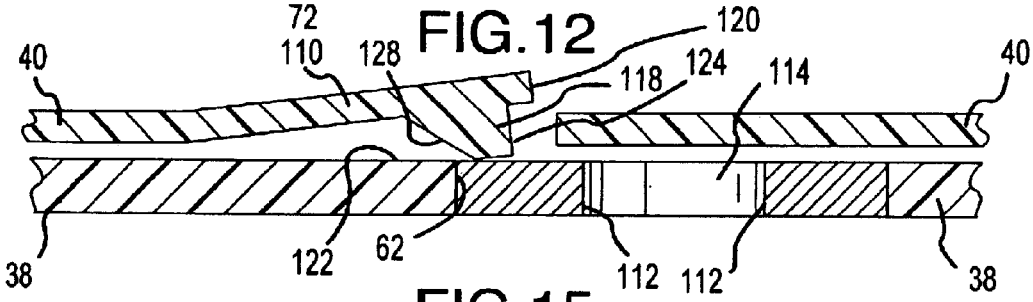
FIG. 15 is a sectional view taken substantially in the plane of line 15—15 of FIG. 8, but with a washer replacing the coin shown in FIG. 8.

A contact extension 118 extends toward the coin wheel 38 from a forward end 120 of the arm 110, as shown in FIG. 15. Normally, the contact extension 118 extends into the groove 84 (FIG. 5). Clearance exists between the lowermost point of the contact extension 118 and the bottom of the groove 84. However, When the coin wheel 38 is rotated toward the position shown in FIG. 8, the slanted surface 86 contacts the contact extension 118 and pushes the contact extension 118 of the arm 110 upward. In this position, the contact extension 118 rests on a surface 122 (FIGS. 5 and 15) slightly rotationally in advance of the receptacle 62. Thus, the arm 110 is biased away from the coin wheel 38 before the coin 60 or washer 114 is moved into contact with the contact extension 118.

Figure 16:
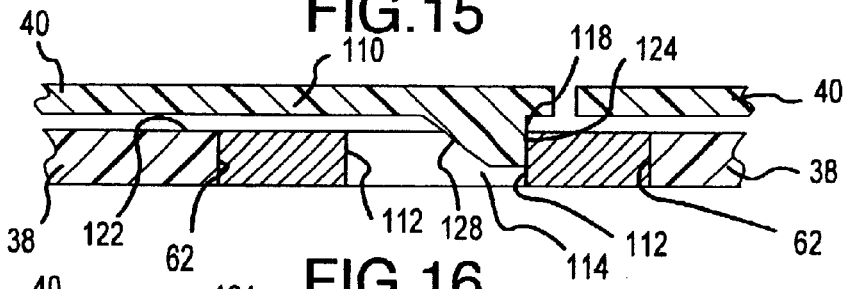
FIG. 16 is a sectional view similar to FIG. 15, showing further rotation of the coin wheel in a forward direction relative to the position shown in FIG. 15.

As the coin wheel 38 rotates in the forward direction, the valid coin 60 or invalid washer 114 moves into position beneath the contact extension 118. The contact extension 118 first moves over the upper surface of the coin 60 or washer 114, as shown in FIG. 15. If a valid coin 60 (not shown in FIGS. 8, 15 or 16) is present in the receptacle 62, the contact extension 118 will continue to ride over the upper surface of the valid coin 60 as the coin wheel 38 continues to rotate in the forward direction. However, if a washer 114 is present in the receptacle 62 (as shown in FIGS. 8, 15 and 16), the bias from the upward-deflected arm 110 pushes the contact extension 118 into the hole 112 of the washer 114, when the hole 112 rotates beneath the contact extension 118, as shown in FIG. 16. Once the contact extension 118 is located in the hole 112, a surface 124 of the contact extension 118 contacts a surface of the washer 114 created by the hole 112. The contact of the surface 124, which faces in the reverse rotational direction, with the surface of the washer 114 formed by the hole 112 prevents any further forward rotational movement of the coin wheel 38. Because the surface 124 of the contact extension 118 and the surface caused by the hole 112 are generally parallel to one another and perpendicular to the direction in which the washer 114 is moved in the forward direction while within the coin receptacle 62, the contact extension 118 will not ride up out of the hole 112, even when considerable force is applied to attempt to rotate the coin wheel 38 in the forward direction. In this manner, further forward rotational movement of the coin wheel is prevented upon detecting an invalid coin having a hole in its center, such as the washer 114.

The arm 110 also performs a second and more precise test of the thickness of the coin 60. As the contact extension 118 rests on the upper surface of the coin 60 when the coin wheel 38 carries the coin 60 in the forward rotational direction, an invalid coin 60 of less than the desired diameter will not elevate the lower surface of the contact extension 118 to the full thickness of the coin wheel 38. Instead, the contact extension 118 to remain slightly within the coin receptacle 62 due to the lesser thickness of the invalid coin, as can be understood from FIG. 15. Further forward rotation of the coin wheel 38 under these circumstances results in the surface 124 of the contact extension 118 contacting the corner surface 104 of the receptacle 62, because the invalid coin 60 has insufficient thickness to lift the lower surface of the contact extension 118 up to the level of the corner surface 104. The forward-facing surface 124 contacts the corner surface 104, and prevents further forward rotation of the coin wheel 38 in a manner similar to the circumstance illustrated in FIG. 16.

Thus, the arm 110 detects invalid coins in the form of a washer 114 and which have less than the desired thickness. Upon detecting a washer 114, the contact extension 118 falls into the hole 112 and prevents the coin wheel 38 from continuing forward rotational movement. Upon detecting a coin 60 of invalid thickness, the contact extension contacts and abuts the corner surface 104 of the coin receptacle 62 and prevents the coin wheel 38 from continuing further forward rotational movement. However, a beveled surface 128 of the contact extension 118 will permit rotation of the coin wheel 38 in the reverse direction (left to right movement of the coin wheel 38 as shown in FIG. 15) so that the coin wheel 38 can be returned to the home position for removal of the invalid washer 114 or the invalid coin of insufficient thickness.

In a similar manner to the arm 68 (FIG. 6), the normal position of the arm 110 results in no bias force being applied to it. The contact extension 118 normally extends into the groove 84 (FIG. 5), and no bias force is applied on the arm 110 until the coin mechanism 38 is operated with a valid coin 60 or invalid washer 114. Since the deflection of the arm 110 occurs intermittently, the natural resilience and strength of the material, preferably acetal plastic, from which the arm 110 is formed is sufficient to apply the bias force necessary to test for the hole 112, without fatiguing the plastic material to the point where inadequate bias force is available to perform the hole and thickness tests.

Figure 2:
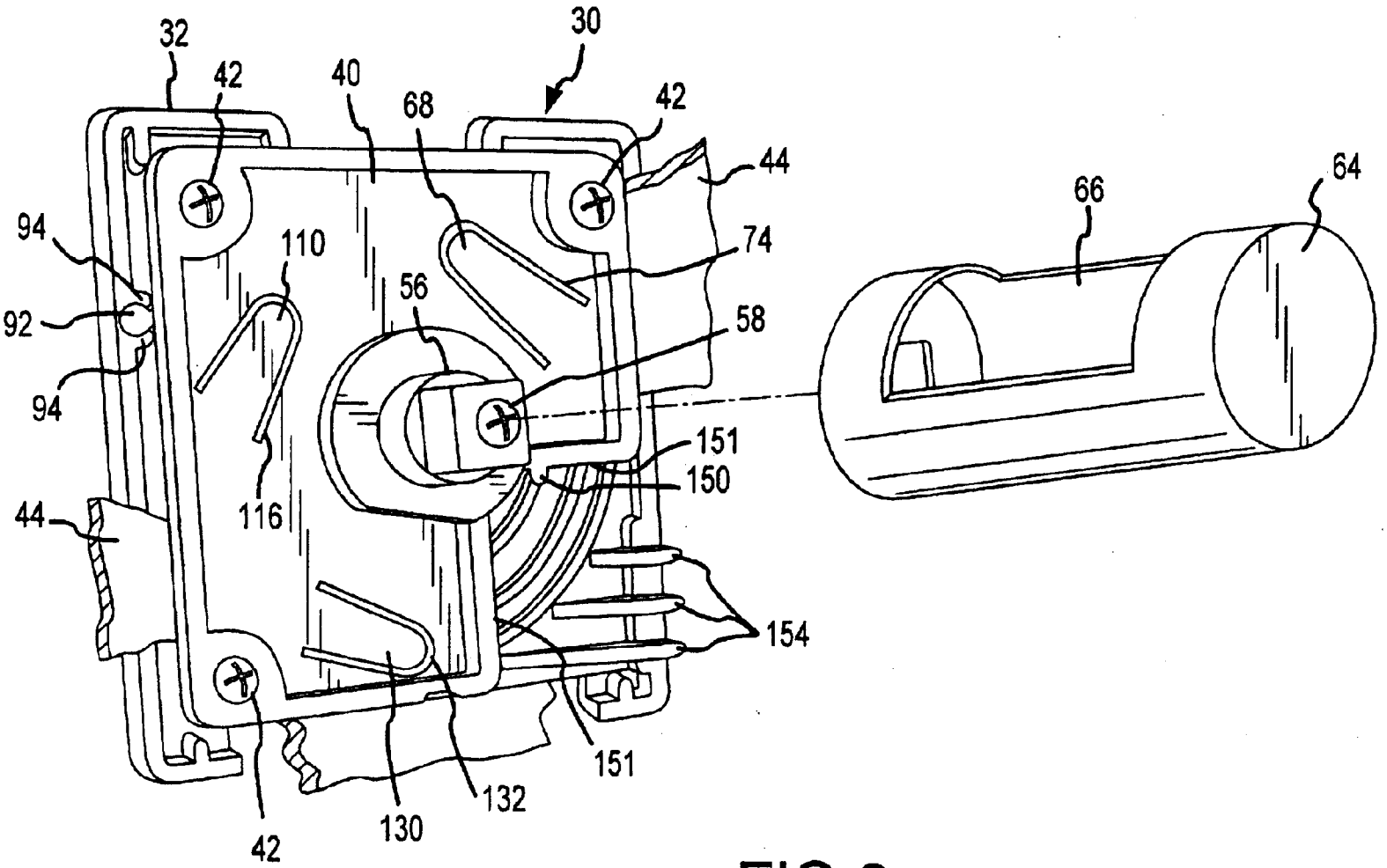
FIG. 2 is a rear perspective and exploded view of the coin mechanism, exterior housing portion and dispenser drum shown in FIG. 1.

The testing arms 68, 90 and 110 therefore operate in the manner described to detect the thickness, diameter and the presence or absence of the hole in the coin. These three tests determine whether or not the coin is valid. If a coin is determined to be invalid in any of these three tests, it is not possible to rotate the coin wheel 38 further in the forward direction to dispense the product out of the opening 66 of the dispenser drum 64 (FIGS. 1 and 2). However, detecting an invalid coin permits the coin wheel 38 to be rotated in the reverse direction to the home position (FIG. 6) to permit the invalid coin to be withdrawn from the receptacle. Permitting the coin wheel 38 to be returned to the home position offers the opportunity to remove the invalid coin so that legitimate authorized vending operations can proceed without the necessity for service and repair of the coin mechanism.

Detecting a valid coin 62 constitutes authorization to vend the product. Vending the product is accomplished by further forward rotation of the coin wheel 38, from the position shown in FIG. 8 to the position shown in FIG. 9. In the position shown in FIG. 9, the dispenser drum 64 (FIGS. 1 and 2) has been rotated sufficiently so that the contents will spill or dump from the opening 66 into a dispensing chute or conduit (not shown) within the vending machine (also not shown). The product moves through the chute or conduit to location where it is collected by the purchaser.

To permit only a single quantity of product to be dispensed through the opening 66 of the dispenser drum 64, the coin mechanism 38 employs and anti-return arm 130. The anti-return arm 130 is also integrally formed by a slot 132 in the backplate 40 to extend in the cantilevered manner. The anti-return arm 130 has the same previously-described characteristics as the arm 110 and the arm 68. The anti-return arm 130 includes a ratchet extension 134 (FIGS. 17 and 18) which extends into a groove 136 (FIG. 5). As shown in FIG. 5, a number of divider walls 138 extend across the groove 136 at a plurality of circumferentially spaced locations.

A relatively lengthy portion 140 of the groove 136 (approximately one-fourth of the circumference of the groove 136 in the coin wheel 38) does not include divider walls 138 within it, as shown in FIG. 5. When the coin wheel 38 is in the home position (FIG. 6), the ratchet extension 134 is located within the portion 140 of the groove 136. Moreover, the portion 140 of the groove 136 extends a sufficient circumferential distance to locate the ratchet extension 134 within it while the coin wheel 38 is rotated through the coin validity testing positions (FIGS. 6–8) where the thickness, diameter and presence and absence of a center hole are tested. The ratchet extension 134 extends into the groove 136 only that amount of distance which provides a clearance space between the ratchet extension 134 and the groove 136. Thus, while the ratchet extension 134 is located within the groove portion 140, it does not influence the forward or return rotation of the coin wheel 38.

Figure 17:
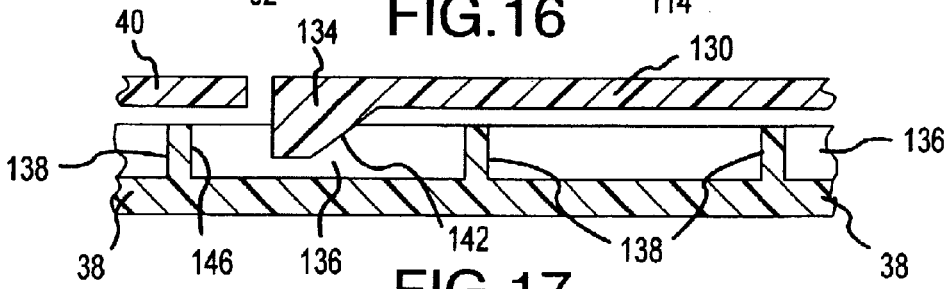
FIG. 17 is a sectional view taken substantially in the plane of line 17—17 of FIG. 9.
Figure 18:
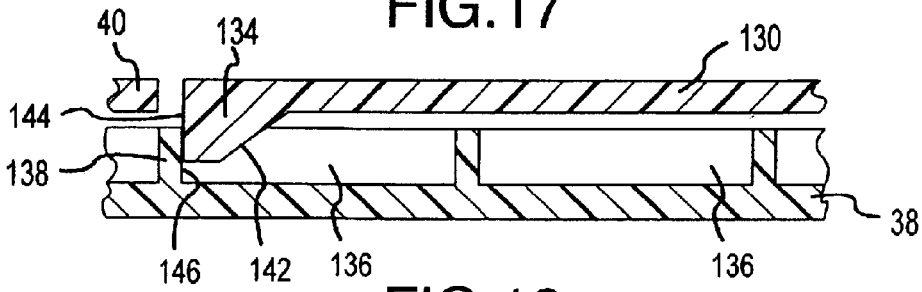
FIG. 18 is a sectional view similar to FIG. 17, showing further rotation of the coin wheel in a forward direction relative to the position shown in FIG. 17.

Upon completing the tests for a valid coin, a beveled surface 142 of the ratchet extension 134, shown in FIGS. 17 and 18, contacts a first divider wall 138*a* which rotationally follows the groove portion 140 (FIG. 5). The beveled surface 142 of the ratchet extension 134 rides up on the divider wall and biases the anti-return arm 130 upward. Further forward rotation of the coin wheel 38 causes a perpendicular surface 144 of the ratchet extension 134 to move past a back vertical surface 146 of the divider wall 138. At this point, the bias from the anti-return arm 130 moves the ratchet extension 134 back into the groove 136. From the rotational position shown in FIG. 17, an attempt to rotate the coin wheel 38 in the reverse direction will result in the perpendicular surface 144 of the ratchet extension 134 contacting the vertical surface 146 of the divider wall 138, as shown in FIG. 18. The contact of the surfaces 144 and 146 prevents further reverse rotation of the coin wheel. Under these conditions, it is only possible to continue rotating the coin wheel 38 in the forward direction to deposit the coin and dispense the product from the vending machine.

The divider walls 138 are relatively closely spaced throughout the remaining portion of the groove 136 not occupied by the portion 140. The relatively close spacing of the divider walls 138 permits only a relatively small amount of reverse movement, and that relatively small amount of reverse movement is insufficient to reverse the rotational position of the dispenser drum 64 enough reload it with product through the opening 66 (FIGS. 1 and 2) after the initial full amount of product has been dispensed. The contact of the ratchet extension 134 with the divider walls 138 thus prevents an attempt to oscillate the dispenser drum 64 back and forth to reload and to dump on the repeated basis multiple quantities of the product with only a single payment. The effect of the ratchet extension 134 with the divider walls 138, and the bias from the anti-return arm 130 and the movement available from the beveled surface 142 permits only further forward rotation of the coin wheel, after a single quantity of the product has been dispensed, until the home position (FIG. 6) is reached.

As shown in FIG. 5, the divider walls 138 have a concave curvature. This concave curvature forces the surface 144 of the ratchet extension 134 into the center of the divider wall 138 and therefore establishes firm restraint against reverse rotational movement. Moreover, the anti-rotation arm 130 is not retained in a deflected position when the coin mechanism 30 is not in use. Accordingly the material, preferably acetal plastic, from which the anti-rotation arm 130 is formed will not lose its structural spring memory characteristic and resilience because of continual deflection. Instead, the relatively short intermittent deflections experienced by the anti-rotation arm 130 are not sufficient to reduce its ability to create sufficient bias to prevent reverse rotation.

Figure 19:
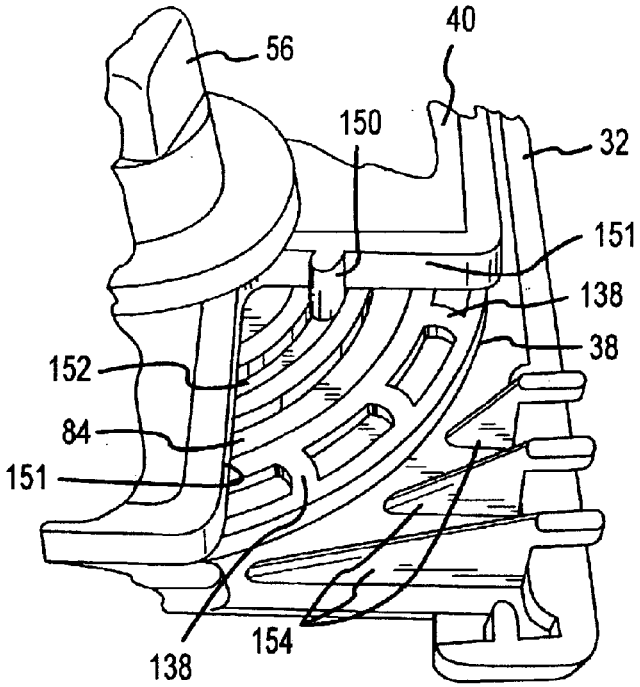
FIG. 19 is an enlarged partial perspective view of a portion of FIG. 10.
Figure 20:
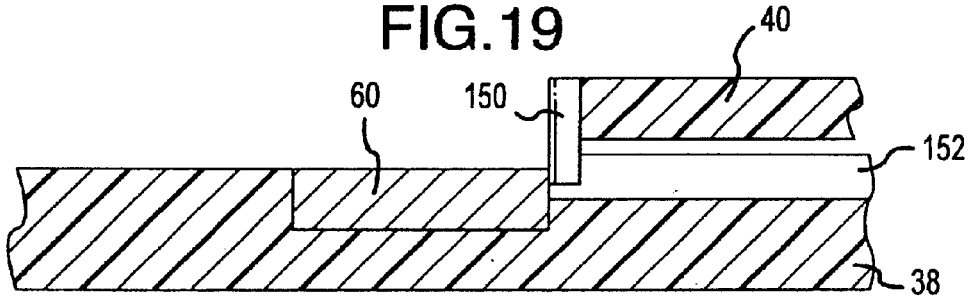
FIG. 20 is an enlarged section view taken substantially in the plane of line 20—20 of FIG. 10.
Figure 21:
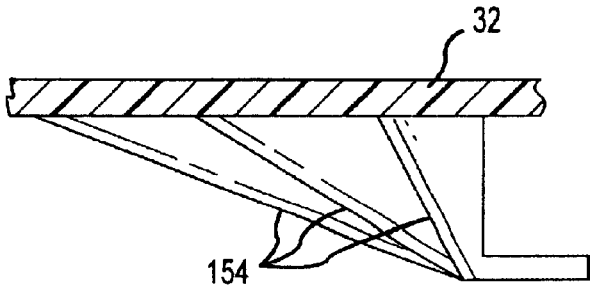
FIG. 21 is an enlarged partial sectional view taken substantially in the plane of line 21—21 of FIG. 4, illustrating features also shown in FIGS. 10 and 19.

Upon rotating the coin wheel 38 further in the forward direction, as permitted by the anti-return arm 130, the coin 60 in the receptacle 62 is extracted at the rotational position shown in FIG. 10. The extraction occurs as a result of a protrusion 150 contacting the outside circular surface 108 of the coin 60 and dislodging the coin 60 out of the receptacle 62. An opening or cut out portion 151 of the back plate 40 permits the coin 60 to be moved out of the receptacle 62, because the cut out portion 151 of the back plate 40 does not confine the coin 60 within the receptacle 62. The protrusion 150 extends from the back plate 40 into a groove 152 (FIG. 5) of the coin wheel 38, as shown in FIG. 10 and 19. A clearance exists between the protrusion 150 and the groove 152 to prevent the protrusion 150 from interfering with normal rotation of the coin wheel 38. The groove 152 opens into the receptacle 62 (FIG. 5).

As the coin 60 in the receptacle 62 moves into contact with the protrusion 150 (FIG. 20), continued rotation of the coin wheel 38 in the forward direction pushes the outside circular surface 108 against the protrusion 150 (FIG. 10), forcing the coin 60 radially outward from the receptacle 62. A series of inclines 154 extend rearwardly from the front plate 32 beneath the protrusion 150, as shown in FIGS. 10 and 19–21. As the coin 60 moves radially outward from the receptacle 62, the coin 60 contacts the inclines 154 to help separate the coin from the coin mechanism 30. The extracted coin falls by gravity into a chute or conduit which leads to a secure container within the vending machine (not shown). Thereafter, continued forward rotation, permitted by the anti-return arm 130, returns to the coin wheel 38 to the home position (FIG. 6), to allow another coin validity testing and product vending sequence to commence upon the insertion of another coin 60 and rotation of the handle 34 (FIG. 1). While in the home position, the opening 66 of the dispenser drum 64 (FIGS. 1 and 2) is facing upward to allow the dispenser drum to be reloaded with product.

Figure 22:
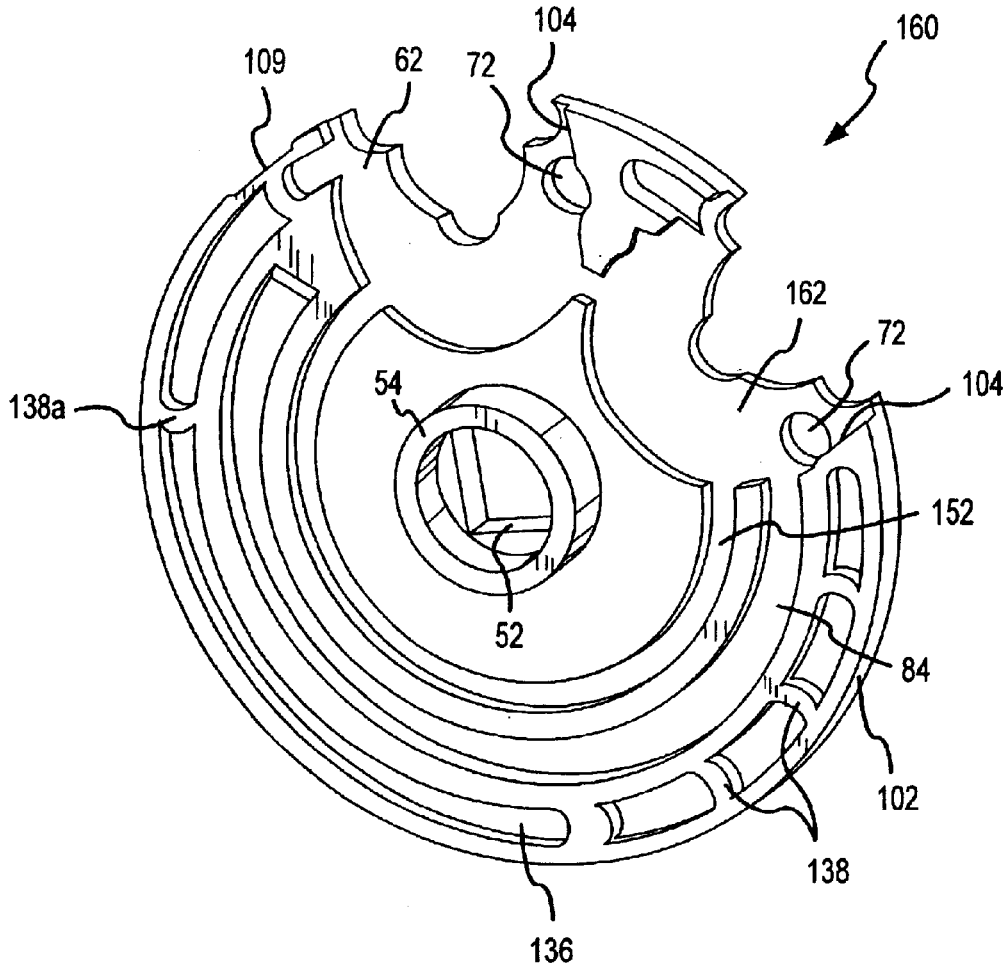
FIG. 22 is an enlarged perspective view of an alternative embodiment of a coin wheel similar to that shown in FIG. 5.

An alternative form of the coin mechanism 30 which may be used to accept and test multiple coins inserted as a single payment for dispensed product, makes use of a coin wheel 160 shown in FIG. 22. All other components of this multiple coin form of the coin mechanism itself are the same as have been described previously. The orientation of the square or rectangular hole in the end wall of the dispenser drum 64 (FIG. 1) is retarded in rotational orientation when the coin wheel 160 is employed, as described below.

The coin wheel 160 includes the first coin receptacle 62 and a second coin receptacle 162. The second coin receptacle 162 is located at a circumferential position on the coin wheel 60 which rotationally follows the first coin receptacle 62. Both coin receptacles 62 and 162 have essentially the same characteristics as previously described. Using the coin wheel 160 permits a first coin to be inserted in the first coin receptacle 62, and after the coin wheel 160 is rotated slightly in the forward direction, and permits a second coin to be inserted into the coin receptacle 162. Dispensing the product requires both coins to be inserted for payment. If the first coin inserted into the first coin receptacle 62 does not test validly by the functionality of the arm 68, in the same manner as previously described, it is not possible to rotate the coin wheel 160 into the second position where the second coin can be inserted into the second coin receptacle 162.

If both coins inserted into the receptacles 62 and 162 test favorably by the functions performed by the arm 68, further forward rotation of the coin wheel tests each of the coins for the proper diameter as a result of the functionality performed by the arm 90, in the same manner as previously described in conjunction with FIGS. 13 and 14. If either the first coin in the first coin receptacle 62 or the second coin in the second coin receptacle 160 is found to be of insufficient diameter, the arm 90 prevents further forward rotation movement of the coin wheel 160 in the same manner as previously described. However, reverse rotational movement of the coin wheel 160 is permitted to remove both of the coins of insufficient diameter, in the manner previously described, even if the first coin in the first coin receptacle 62 is valid but the second coin in the second coin receptacle 162 is invalid.

In a similar manner, if either of the coins in the receptacles 62 or 162 is a washer 114, or if either of the coins are of insufficient thickness, as tested by the arm 110, further forward rotation of the coin wheel 160 will be prevented in the same manner as previously described. A washer(s) or an invalid coin(s) of insufficient thickness can still be removed from the coin mechanism 30 as a result of reverse rotational movement of the coin wheel 160, in the manner and for the reasons previously described.

Once the coins in the receptacles 62 and 162 have been tested as valid, the anti-return arm 130 prevents the reverse rotation of the coin wheel 160 in the same manner as has previously been described. However, because it is necessary to test two coins in the two receptacles 62 and 162, the location of the divider wall 138*a* in the groove 136 is positioned at a position which is rotationally delayed or retarded in the coin wheel 160, as compared to the position of the divider wall 138*a* in the groove 136 of coin wheel 38 shown in FIG. 5. Moreover, the number of divider walls when 38 in the groove 136 is reduced in the coin wheel 160, and shown in FIG. 22.

The rotational orientation of the dispenser drum 64 relative to the end piece 56 of the coin mechanism is retarded by approximately forty-five rotational degrees when the two-coin form of the coin wheel 160 is employed in the coin mechanism 30. The retarded orientation is achieved by changing the orientation of the square or rectangular hole formed in the end wall of the dispenser drum 64 (FIG. 1) or changing the orientation of the square or rectangular shaped portion on the end piece 56 (FIG. 1). The retarded position of the dispenser drum 64 orients the opening 66 of the dispenser drum 64 to prevent any product within the dispenser drum 64 from spilling from the container 66 (FIGS. 1 and 2) as the second of the two coins is tested for validity. If the opening 66 in the dispenser drum 64 was not rotationally retarded in position, it might be possible to "bleed" product from the vending machine by rotating the coin wheel to the position where a second coin was tested and found to be invalid and then back to the home position on a repeated basis. Such rotational oscillation is possible because reverse rotation back to the home position is possible when second coin tests invalid. By rotationally retarding the position of the opening 66 in the dispenser drum 64 (FIG. 1) when the two-coin form of the coin wheel 160 is used, the orientation of the opening 66 prevents the contents of the dispenser drum 64 from spilling out until after the second coin has been tested and determined to be valid. Furthermore, rotationally retarding the position of the opening 66 in the dispenser drum 64 also prevents the dispenser drum from being loaded with product until the second coin has been tested as valid. The first divider wall 138*a* is located within the groove 136 of the coin wheel 160 to prevent reverse rotation of the coin wheel 160 after the second coin has been tested as valid.

Use of the coin wheel 160 in the coin mechanism permits larger payments to be obtained for vending more expensive products than would otherwise be obtained by payment from a single coin. Larger payments for more expensive dispensed products may also be obtained by stacking two coins, one on top of the other, in one or two coin receptacles 62 in another form of a coin wheel (not shown), provided that the coin receptacle(s) and the coin wheel are sufficiently thick to permits stacking the coins. The arms 68, 90 and 110 will perform most of their essential functions under this stacked-coin situation, except that locating a washer 114 below a valid coin 60 will prevent the arm 110 from detecting the washer. If a single arm 90 is employed, it will respond to the diameter of the one of the coins with which it is aligned. However, two diameter-detecting arms 90 may be located or stacked in a vertically positioned relationship with respect to one another, so that each of the arms is aligned with and capable of detecting the diameter of each individual stacked coin. Under these circumstances, operation of the coin mechanism will be prevented if either one of the two stacked coins is of invalid diameter.

Figure 23:
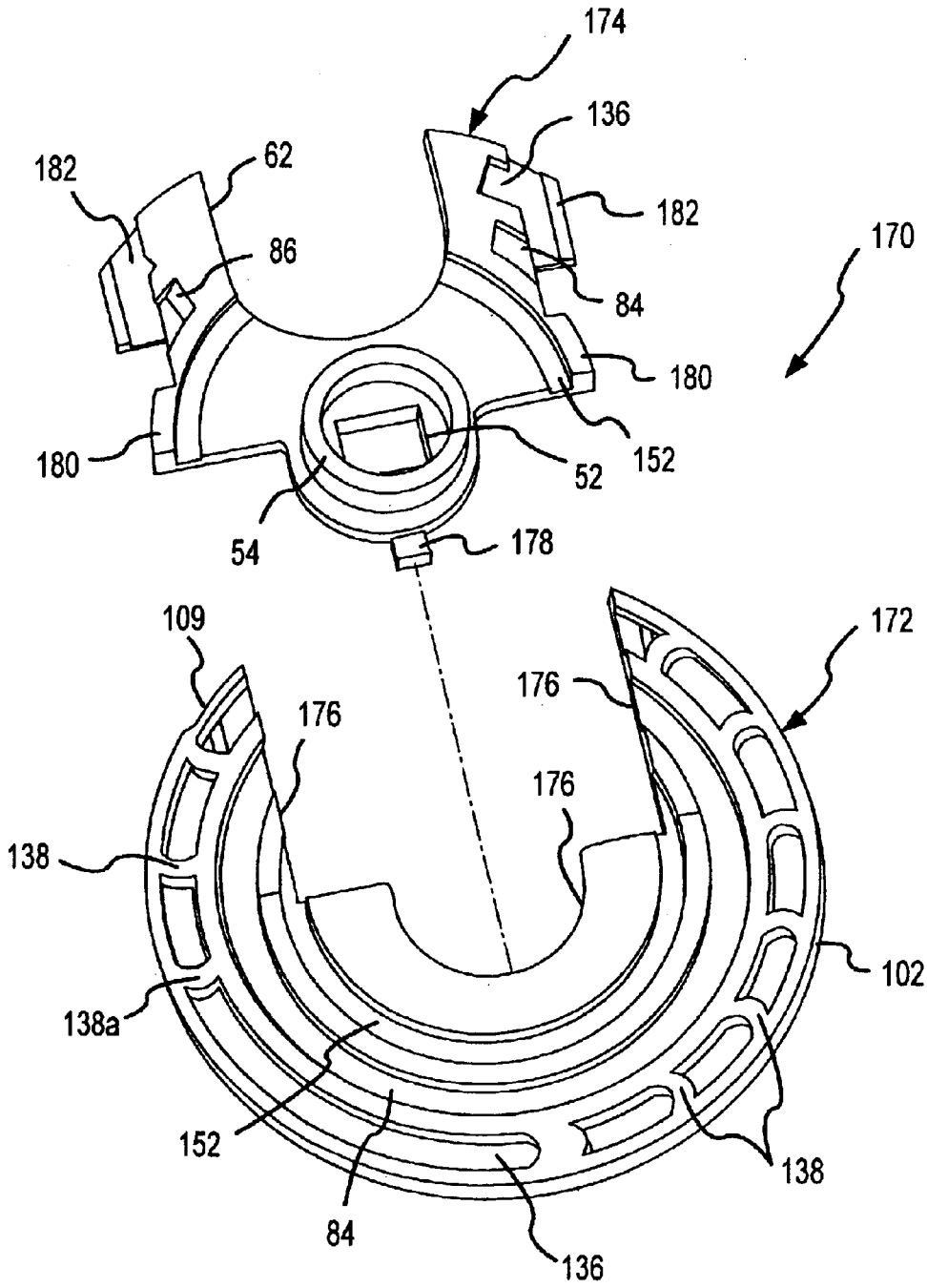
FIG. 23 is enlarged perspective view of another alternative embodiment of a coin wheel similar to that shown in FIG. 5, shown in exploded relationship.
Figure 24:
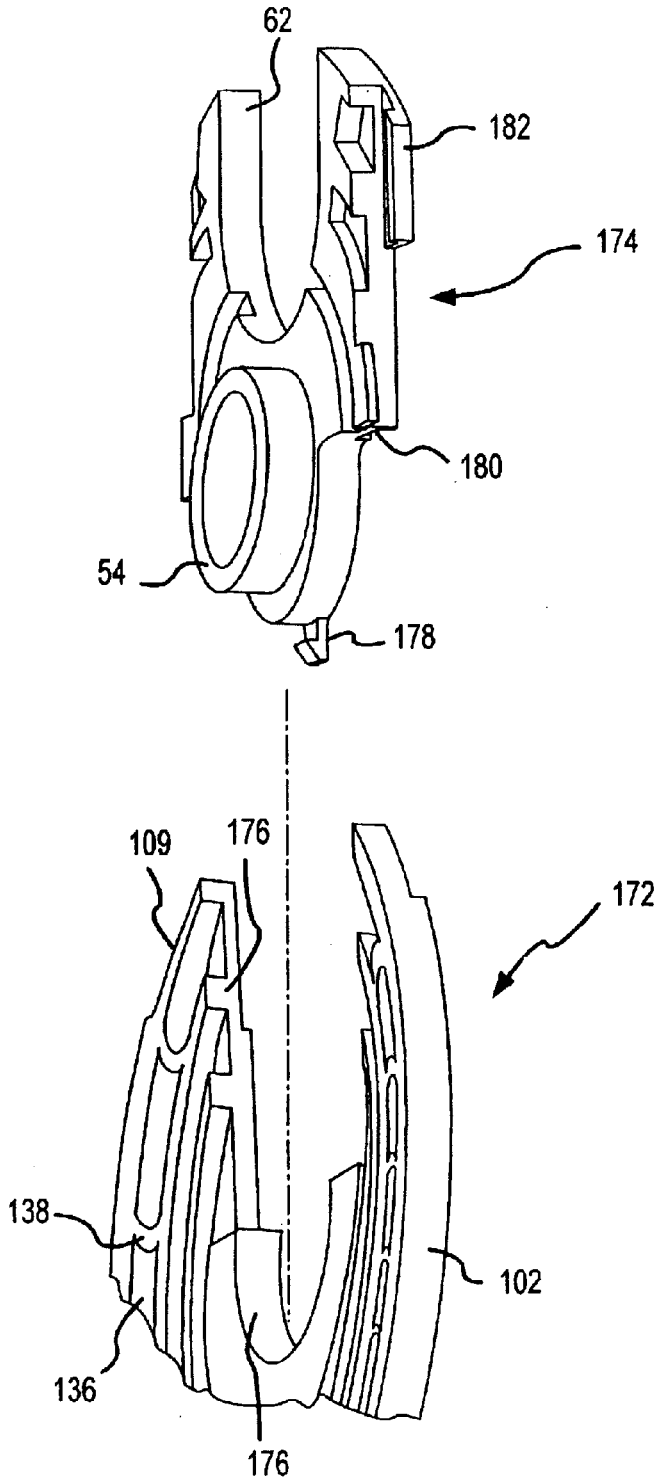
FIG. 24 is a view of the coin wheel shown in FIG. 23, shown partially and from a different perspective.
Figure 25:
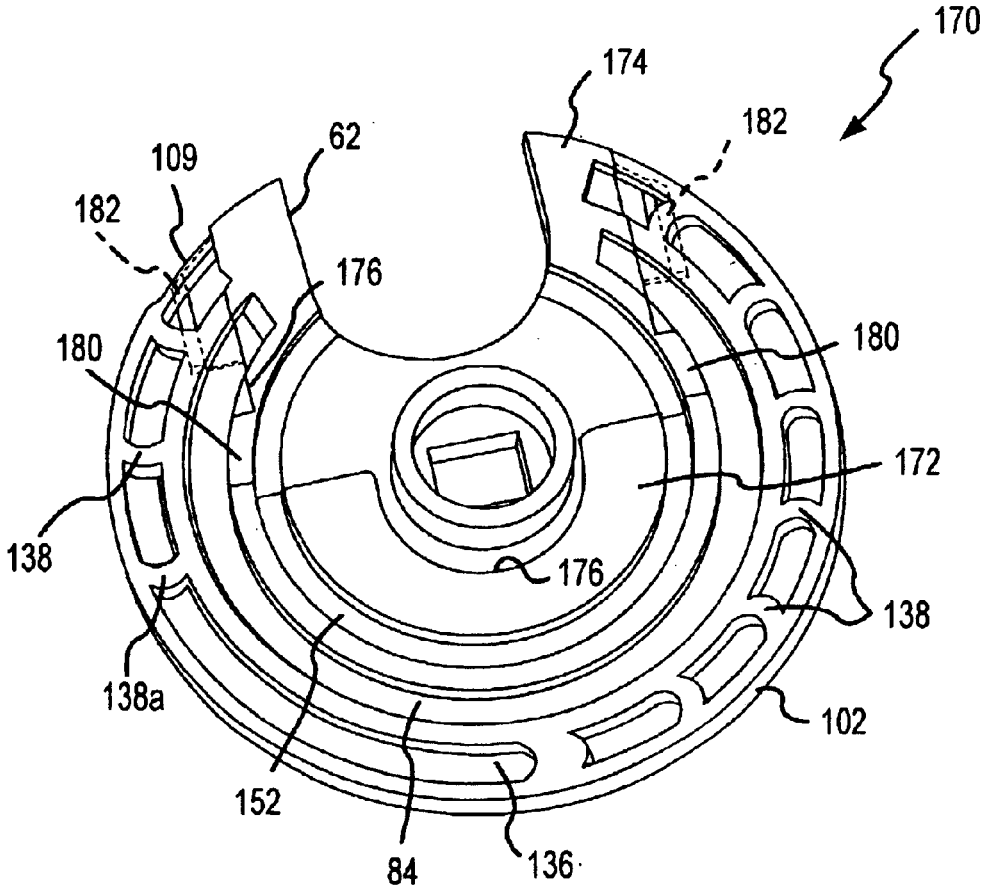
FIG. 25 is a perspective view of the coin wheel shown in FIGS. 23 and 24 shown in an assembled relationship.

Typically, a different coin wheel must be fabricated for each coin which is to be accepted as payment. Consequently, different coin wheels require different molds because each of the coin receptacles is of a different size. Alternatively, each coin receptacle can be milled from the plastic, but milling the coin receptacles adds to the manufacturing cost. Since a considerable amount of the cost associated with forming plastic parts is the direct result of fabricating the mold for those plastic parts, the costs may be reduced by creating a coin wheel 170 which is formed by a common portion 172 and by an insert portion 174, as shown in FIGS. 23–25. The common portion 172 is similar to and contains the previously-described features of the coin wheel 38, other than those features which are contained an insert portion 174. The insert portion 174 contains the coin receptacle 62 which is uniquely sized to accept each unique size of coin. The insert portion 174 is connected to the common portion 172 to form the complete coin wheel 170 as shown in FIG. 25.

The insert portion 174 fits within a cut out area 176 formed by the common portion 172. The insert portion 174 includes the square or rectangular hole 52 and the cylindrical sleeve 54. The grooves 84, 136 and 152 continue into the insert portion 174, and the inclined surface 86 is also formed on the insert portion 174. To hold the insert portion 174 firmly with respect to the common portion 172, a hook 178 and two wings 180 and 182 are formed on the insert portion 174. The wings 180 and 182 fit on the front and rear sides, respectively, of the common portion 172, as shown in FIGS. 23–25. The hook 178 fits into a receptacle (not shown) on the back side of the common portion 172. The hook 178, in its position within the receptacle (not shown), prevents the insert portion 174 from being withdrawn out of the cut out area 176 in a radial direction relative to the common portion 172. The wings 180 and 182 prevent the insert portion from moving axially forward or rearward out of the cut out area 176. In addition, once the coin wheel 170 is retained between the front plate 32 and the back plate 40 (FIGS. 1–3) in the coin mechanism, there is additional support for preventing the insert portion 172 from separating in axial and radial directions out of the cut out area 176 of the common portion 172.

A coin wheel 170 of the type having the insert portion 174 with a coin receptacle 62 specifically sized to accept a particular coin, and a common portion 172 which incorporates the remaining common features in the coin wheel, permits the same coin mechanism to be used economically for a wide variety of different coins, without incurring the additional and considerable expenses of creating a separate mold for each different coin wheel. The use of the insert portion 174 is a particular advantage when it is necessary to accommodate a variety of different denominations and sizes of coins, particularly coins which are larger in diameter than is typical. Different molds for only the insert portions 174 are required, and those different molds differ only by the size of the coin receptacle 62. Moreover, dividing the coin wheel 170 into the common portion 172 and the insert portion 174 allows the size of the coin receptacle 62 to be milled or machined to into the insert portion 174. In this circumstance, only two molds are required, one for the common portion 172 and one for the insert portion 174. Differences in coin size are accommodated by milling the desired shape and size of the coin receptacle 62 into only the insert portion 174, or by separately forming only the insert portion 74 for each different size of coin.

Figure 3:
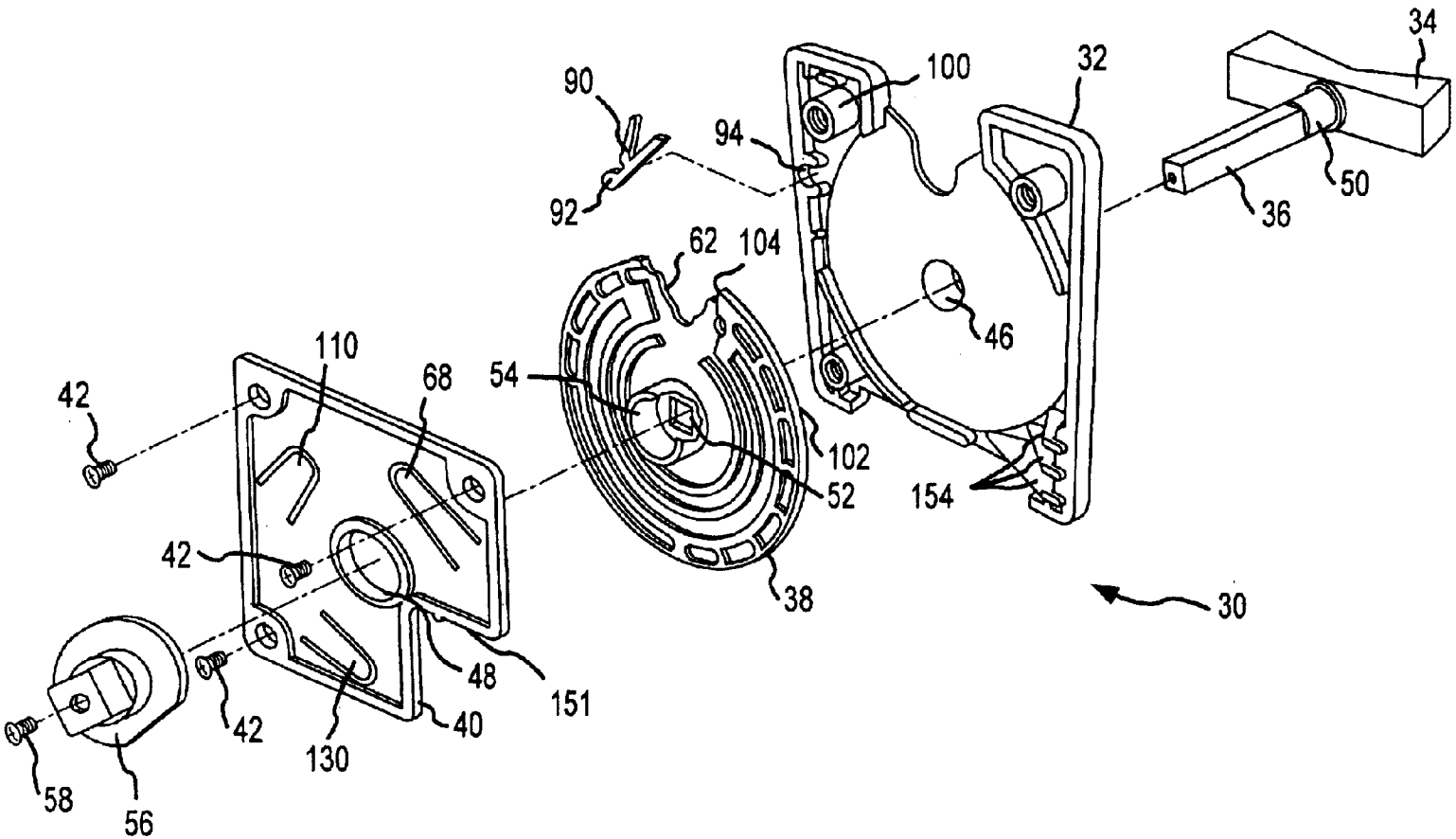
FIG. 3 is an exploded perspective view of the components of the coin mechanism shown in FIGS. 1 and 2.
Figure 4:
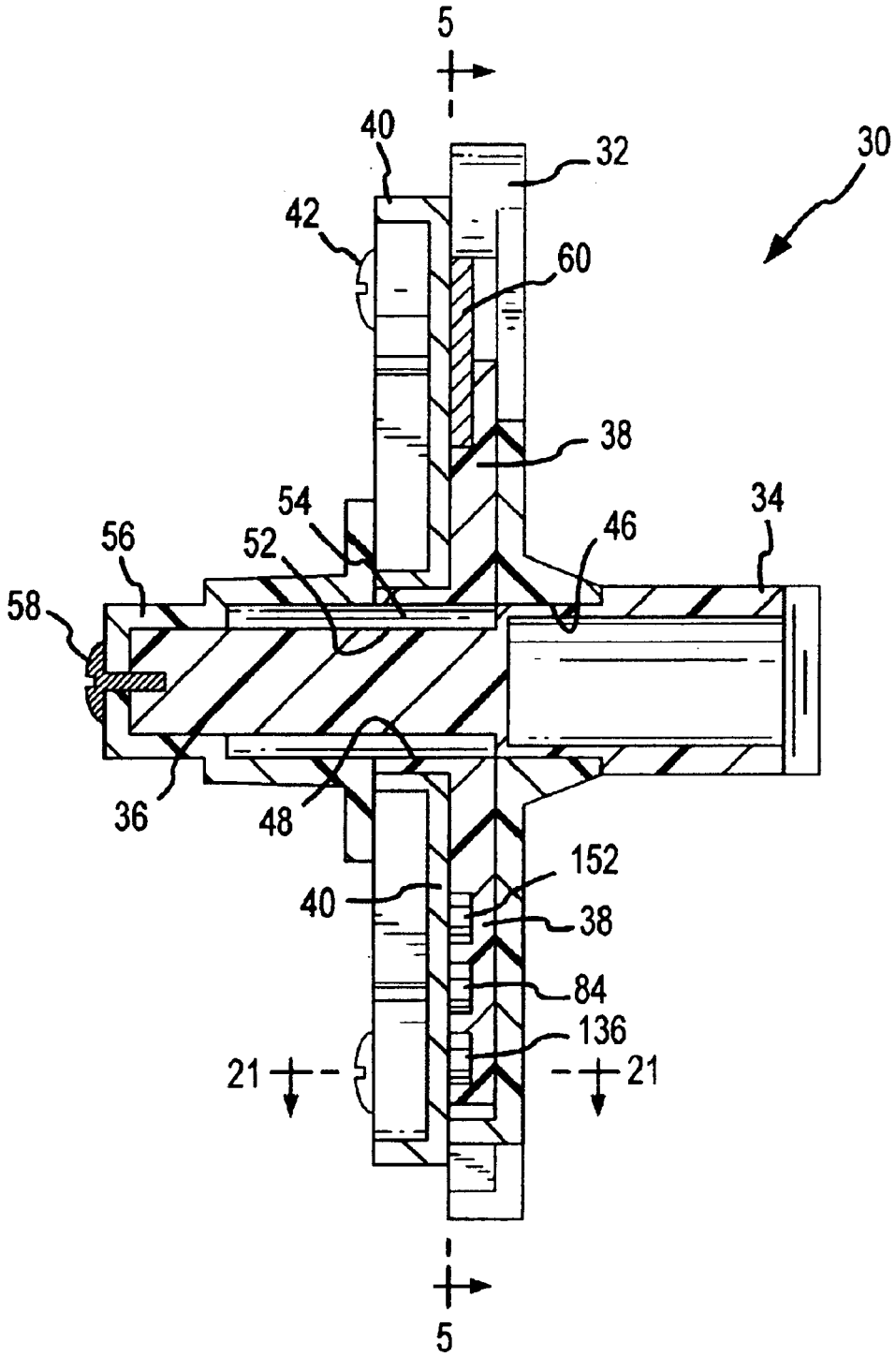
FIG. 4 is an enlarged vertical cross-sectional view of the coin mechanism taken substantially in the plane of line 4—4 of FIG. 1.

As shown in FIG. 3, the entire coin mechanism 30 is formed by only six components, not including the screws to hold those components together. Of those six components, the major functions of coin validity testing and vending are achieved by the interaction of the coin wheel 38 and the arms 68, 90, 110 and 130. The arms 68, 110 and 130 are integrally formed with the back plate 140. Preferably all the components (other than the screws) are formed by injection molding from durable and resilient plastic material or engineering resin, such as acetal. Forming the coin mechanism components from molded plastic permits those components to be manufactured efficiently and economically with a high degree of precision. Moreover, the configurations of the various elements which perform the thickness testing, diameter testing and hole presence testing on the coin and which perform the anti-rotation and coin extraction functions, are readily established by the characteristics of the molds from which those components are molded and the characteristics of the plastic material from which those components are formed. The resilience and spring memory characteristics which are inherently built into the test arms eliminate the need for separate springs and complicated assembly. The organization and arrangement of the various elements perform the coin validity testing, anti-rotation and extraction functions with a high degree of accuracy, and result in a high level of precision in the functionality of the coin mechanism. Because of the relatively small number of parts employed in the coin mechanism, and their integral functionality, organization and arrangement, it is a relatively simple and straightforward task to assemble the coin mechanism from its component parts. Many other advantages and improvements will be apparent upon gaining a complete understanding of the present invention.

A presently preferred embodiment of the invention and many of its improvements and advantages have been described with a degree of particularity. This description is of a preferred example of the invention, and is not necessarily intended to limit the scope of the invention. The scope of the invention is defined by the following claims.

The invention claimed is:

1. A coin mechanism for testing validity of a coin, comprising:

a back plate;

a coin wheel positioned to rotate adjacent and relative to the back plate, the coin wheel including a receptacle within which to receive the coin; and at least one test arm integrally connected to the back plate and extending to a position over the coin wheel to contact the coin within the receptacle, the test arm resiliently moving in response to contacting a characteristic of the coin, the degree of movement of the test arm indicating validity with respect to the characteristic.

2. A coin mechanism as defined in claim 1, wherein:

the arm interacts with the coin wheel to prevent rotation of the coin wheel in at least one rotational direction until the test arm is moved to the degree indicating validity.

3. A coin mechanism as defined in claim 2, wherein:

the test arm permits rotation of the coin wheel in the rotational direction opposite of the one rotational direction whenever the test arm is moved to a degree other than the degree indicating validity.

4. A coin mechanism as defined in claim 1, wherein:

the test arm extends in a cantilever manner from the back plate.

5. A coin mechanism as defined in claim 4, wherein:

the back plate includes a generally planar portion; and the test arm is defined by a slot within the generally planar portion which separates the test arm from the remaining generally planar portion.

6. A coin mechanism as defined in claim 4, wherein:

the movement of the test arm which indicates validity occurs in opposition to bias force resulting from deflecting the test arm relative to the remaining generally planar portion of the back plate.

7. A coin mechanism as defined in claim 6, wherein:

the test arm is substantially free of bias force resulting from deflection until the test arm is moved.

8. A coin mechanism as defined in claim 1, further comprising:

first and second ones of the test arms, the first test arm moving in response to a thickness characteristic of the coin, the second test arm moving in response to a hole characteristic of the coin.

9. A coin mechanism as defined in claim 8, further comprising:

a third test arm pivotally connected relative to the back plate and extending to contact the coin within the receptacle, the third test arm moving in response to a diameter characteristic of the coin contacted, the degree of movement of the third test arm indicating validity with respect to the diameter characteristic.

10. A coin mechanism as defined in claim 9, connected to rotate a dispenser apparatus and dispense product from the dispenser apparatus, further comprising:

an anti-rotational arm integrally connected to the back plate and extending to a position over the coin wheel to contact a structure of the coin wheel to prevent rotation the coin wheel and the connected dispenser apparatus in a rotational direction opposite of the rotational direction which resulted in the first and second test arms moving to the degree indicating validity.

11. A coin mechanism as defined in claim 10, further comprising:

a front plate positioned with respect to the back plate with the coin wheel rotationally positioned between the front and back plates; and a handle extending through the front plate and connected to the coin wheel for rotating the coin wheel.

12. A coin mechanism as defined in claim 11, wherein:

each of the front plate, handle, coin wheel, back plate including the integrally connected first and second test and anti-rotation arms, and the third test arm are formed from plastic.

13. A coin mechanism as defined in claim 12, wherein:

the plastic is substantially of the acetal type.

14. A coin mechanism as defined in claim 13, wherein:

each of the front plate, handle, coin wheel, back plate including the integrally connected first and second test and anti-rotation arms, and the third test arm are molded plastic.

15. A coin mechanism as defined in claim 1, wherein:

the coin wheel includes first and second receptacles which receive first and second coins; and the first and second receptacles are positioned at different rotational locations on the coin wheel.

16. A coin mechanism as defined in claim 1, wherein:

the coin wheel includes a common portion and an insert portion which are mechanically connected together; and the receptacle for the coin is formed in the insert portion.

17. A method for testing validity of a coin, comprising:

positioning a coin in a receptacle of a coin wheel;

positioning a back plate stationarily relative to the coin wheel;

extending a test arm integrally connected to the back plate into contact the coin within the receptacle the coin wheel;

rotating the coin wheel in a first rotational direction with the coin in the receptacle;

moving the test arm in response to contacting the coin in the receptacle in the coin wheel as the coin wheel rotates; and determining a validity characteristic of the coin by the degree of movement of the test arm.

18. A method as defined in claim 17, further comprising:

interacting the arm with the coin wheel to prevent further rotation of the coin wheel in the first rotational direction until the test arm is moved to the degree indicating validity.

19. A method as defined in claim 18, further comprising:

rotating the coin wheel in a second rotational direction opposite of the first rotational direction whenever the test arm is moved to a degree other than the degree indicating validity.

20. A method as defined in claim 17, further comprising:

extending the test arm in a cantilever manner into contact with the coin in the receptacle in the coin wheel.

21. A method as defined in claim 20, further comprising:

defining the test arm by a slot formed within a generally planar portion of the back plate.

22. A method as defined in claim 17, further comprising:

generating inherent bias force within the test arm from opposition to movement of the test arm when the test arm contacts the characteristic of the coin.

23. A method as defined in claim 22, further comprising:

maintaining the test arm substantially free of inherent bias force when the test arm is out of contact with the characteristic of the coin.

24. A method as defined in claim 17, further comprising:

extending a plurality of ones of the test arms into contact with thickness, diameter, and hole characteristics of the coin.

25. A method as defined in claim 24, further comprising:

rotating a dispenser apparatus in conjunction with the coin wheel;

dispensing product from the dispenser apparatus upon rotation in the first direction to a predetermined rotational position; and extending an anti-rotational arm integrally connected to the back plate into contact with a structure of the coin wheel to prevent rotation of the dispenser apparatus in the second rotational direction after the thickness, diameter and hole characteristics of the coin have been tested as valid.

26. A method as defined in claim 17, further comprising:

positioning separate coins in each of first and second receptacles of the coin wheel.

27. A method as defined in claim 17, further comprising:

forming the coin wheel by connecting a common portion and an insert portion of the coin wheel together; and inserting the coin in the receptacle formed in the insert portion.

* * * * *